US011553825B2

(12) United States Patent
Grandstrand et al.

(10) Patent No.: US 11,553,825 B2
(45) Date of Patent: Jan. 17, 2023

(54) FLOOR TREATMENT APPARATUS AND METHOD

(71) Applicant: SharkNinja Operating, LLC, Needham, MA (US)

(72) Inventors: Paul Grandstrand, Brighton, MA (US); Alan Weeks, South Easton, MA (US); Jason Boyd Thorne, Dover, MA (US); Thomas David Reid Ford, Wellesley, MA (US); Claudia Joann Richardson, Ventura, CA (US)

(73) Assignee: SharkNinja Operating LLC, Needham, MA (US)

( * ) Notice: Subject to any disclaimer, the term of this patent is extended or adjusted under 35 U.S.C. 154(b) by 747 days.

(21) Appl. No.: 16/366,617

(22) Filed: Mar. 27, 2019

(65) Prior Publication Data

US 2019/0216286 A1 Jul. 18, 2019

Related U.S. Application Data

(60) Division of application No. 15/268,448, filed on Sep. 16, 2016, now abandoned, which is a continuation of application No. PCT/US2015/021588, filed on Mar. 19, 2015.

(60) Provisional application No. 62/036,647, filed on Aug. 13, 2014, provisional application No. 61/955,766, filed on Mar. 19, 2014.

(51) Int. Cl.

*A47L 13/22* (2006.01)
*A47L 13/12* (2006.01)

(Continued)

(52) U.S. Cl.

CPC ..... *A47L 13/225* (2013.01); *A47L 9/04* (2013.01); *A47L 9/06* (2013.01); *A47L 11/4086* (2013.01);

(Continued)

(58) Field of Classification Search

CPC ..... A47L 13/225; A47L 11/4086; A47L 11/4088; A47L 13/12; A47L 13/22;

(Continued)

(56) References Cited

U.S. PATENT DOCUMENTS 1,408,074 A * 2/1922 Case ..... A47L 9/0455 15/376
1,462,568 A * 7/1923 Case ..... A47L 9/0494 15/368

(Continued)

FOREIGN PATENT DOCUMENTS

CN 103462562 * 12/2013

OTHER PUBLICATIONS

PCT Search Report and Written Opinion dated Jun. 29, 2015, received in PCT Application No. PCT/US15/21588, 18 pgs.

*Primary Examiner* — Robert J Scruggs
(74) *Attorney, Agent, or Firm* — Grossman Tucker Perreault & Pfleger, PLLC

(57) ABSTRACT

A floor treatment device may include a body portion comprising one or more pumps, one or more spray outlets, and one or more reservoir receptacles configured to receive one or more reservoirs. The one or more pumps are operable to be activated and direct liquids to the spray outlets. The device may include swappable heads, each comprising a body connector configured to mate with a head connector of the body portion. In an embodiment, the head connector may include a sensor system and a controller communicatively connected to the sensor system. When one of swappable heads is connected to the body portion, the sensor system is configured to detect the identity of the swappable heads connected, and the controller is configured to selectively activate, based on the identity of the swappable heads, at least one of the one or more pumps.

19 Claims, 39 Drawing Sheets

(51) Int. Cl.
*A47L 9/04* (2006.01)
*A47L 9/06* (2006.01)
*A47L 11/40* (2006.01)

(52) U.S. Cl.
CPC ..... *A47L 11/4088* (2013.01); *A47L 13/12* (2013.01); *A47L 13/22* (2013.01)

(58) Field of Classification Search
CPC ..... A47L 13/20; A47L 13/24; A47L 13/256; A47L 13/16; A47L 13/254; A47L 9/00; A47L 9/02; A47L 9/04; A47L 9/0405; A47L 9/0427; A47L 9/0455; A47L 9/0461; A47L 9/06; A47L 9/0633; A47L 9/066; A47L 9/0666; A47L 9/0673
See application file for complete search history.

(56) References Cited

U.S. PATENT DOCUMENTS 1,462,574 A * 7/1923 Howard ..... A47L 9/0455 15/368
1,856,289 A * 5/1932 Owens ..... A46B 13/001 15/105
3,748,679 A * 7/1973 Rosendall ..... A47L 11/4038 15/388
4,912,805 A * 4/1990 Krasznai ..... A47L 9/0477 15/207.2
5,440,216 A 8/1995 Kim
6,094,776 A * 8/2000 Fish ..... A47L 9/062 15/364
8,584,307 B2 11/2013 Won et al.
2004/0184867 A1* 9/2004 Wang ..... A47L 13/12 401/279
2005/0039282 A1* 2/2005 Paterson ..... A47L 9/0477 15/179
2009/0165822 A1 7/2009 Kintz et al.
2009/0306822 A1 12/2009 Augenbraun et al.
2010/0043167 A1 2/2010 Bradbury et al.
2010/0063628 A1 3/2010 Landry et al.
2010/0078318 A1 4/2010 Huffman
2012/0124769 A1* 5/2012 Krebs ..... A47L 9/00 15/368
2013/0180547 A1* 7/2013 Kent ..... A46B 13/02 134/6
2013/0318725 A1 12/2013 Kellis et al.
2014/0259475 A1* 9/2014 Doughty ..... A47L 11/4072 15/207.2

* cited by examiner

FLOOR TREATMENT APPARATUS AND METHOD

CROSS REFERENCE TO RELATED PATENT APPLICATIONS

This application is a divisional application of U.S. patent application Ser. No. 15/268,448 filed on Sep. 16, 2016, which is a continuation application of PCT Application No. PCT/US15/21588 filed on Mar. 19, 2015, which claims the benefit U.S. Provisional Patent Application Nos. 61/955,766 filed Mar. 19, 2014 and 62/036,647 filed Aug. 13, 2014, all of which are fully incorporated herein by reference.

TECHNICAL FIELD

Aspects described herein generally relate to surface treatment apparatuses and methods such as floor cleaning appliances and methods.

BACKGROUND

Surface treatment appliances are used in the home, office and other locations to treat floors and other surfaces. Various types of surface treating appliances, such as appliances with oscillating and/or rotating brushes, are known for cleaning carpets. Additionally, certain types of surface treating appliances, such as spray appliances with padded configurations or steam mops with steam cleaning heads, may be used for cleaning hard floors.

SUMMARY

In one embodiment, a surface treating device includes a body having first end and second end, a handle configured to be coupled to the first end of the body, and a plurality of swappable heads each having a connector configured for coupling to the second end of the body. In an embodiment, one of the heads may include a water reservoir, a heating element for converting water from the water reservoir to steam, and an outlet for delivering the steam onto a surface to be cleaned, where the water reservoir and the heating element are substantially on the same plane.

In one example, the water reservoir and the connector are at distal ends of the floor treatment head. In another example, the floor treatment head is operable to support a removably attachable floor cleaning pad. In some embodiments, the water reservoir includes one or more members perpendicularly attached to an interior surface of the water reservoir, where the members are operable to mitigate water movements through the water reservoir. In one embodiment, the water reservoir extends along one or more sides of the floor treatment head. In operation, the water reservoir and the heating element are both located at substantially equal distance from the connector such that substantially similar moments of force are exerted on the water reservoir and the heating element when the floor treatment head is in use. In one embodiment, the surface treating device further includes an adjustable spray outlet located on the body. Alternatively, the adjustable spray outlet may be located on the floor treatment head.

In one embodiment, a surface treating system includes a body and at least two floor treatment heads, where the first floor treatment head and the second floor treatment head are configured to be removably attachable to the body, and where the body is configured to receive only one floor treatment head at a time. The first floor treatment head includes a hard floor cleaning head having a base, where the base is capable of supporting a first removably attachable floor cleaning pad. The second floor treatment head includes a steam cleaning head having a connector configured for coupling to the body, the steam cleaning head having a water reservoir, a heating element operable to convert water from the water reservoir to steam, and an outlet for delivering the steam onto a surface to be cleaned, where the water reservoir and the heating element are substantially on the same plane.

In one embodiment, the water reservoir and the connector are at distal ends of the steam cleaning head. In another embodiment, the steam cleaning head is operable to support a second removably attachable floor cleaning pad. In some embodiments, the water reservoir includes one or more members perpendicularly attached to an interior surface of the water reservoir, the members operable to mitigate water movements through the water reservoir.

In one embodiment, the surface treating system further includes an adjustable spray outlet located on the body. Alternatively, the adjustable spray outlet may be located on the hard floor treatment head, or on the steam cleaning head. In another embodiment, the water reservoir extends along one or more sides of the steam cleaning head. In operation, the water reservoir and the heating element are both located at substantially equal distance from the connector such that substantially similar moments of force are exerted on the water reservoir and the heating element when the steam cleaning head is in use.

In one embodiment, a surface treating apparatus includes a body, and a floor treatment head disposed with the body, the floor treatment head including a member for supporting a brush roll, the brush roll having a plurality of floor treatment implements. In another embodiment, the brush roll is removably detachable from the member. In one instance, the brush roll includes a plurality of brush roll modes pertaining to the plurality of floor treatment implements or other brush roll modes.

In one mode of operation, a first brush roll mode includes a first floor treatment implement positioned to be in contact with a floor surface without a second floor treatment implement being in position to be in contact with the floor. In another mode of operation, a second brush roll mode includes a second floor treatment implement positioned to be in contact with a floor surface without a first floor treatment implement being in position to be in contact with the floor. In yet another mode of operation, a third brush roll mode includes a configuration of the brush roll where neither a first floor treatment implement nor a second floor treatment implement being in position to be in contact with a floor surface. In some embodiments, a control member is disposed with the brush roll, the control member operable to move and position the brush roll into any of the brush roll modes.

In one embodiment, a surface treating system includes a body, and at least three floor treatment heads, where each of first floor treatment head, second floor treatment head, and third floor treatment head is configured to be removably attachable to the body, and whereby the body is configured to receive only one floor treatment head at a time. The first floor treatment head includes a steam cleaning head having a connector configured for coupling to the body, the steam cleaning head includes a water reservoir, a heating element operable to convert water from the water reservoir to steam, and an outlet for delivering the steam onto a surface to be cleaned, where the water reservoir and the heating element are substantially on the same plane. The second floor treatment head includes a hard floor cleaning head having a base, the base operable to support a first removably attachable floor cleaning pad. The third floor treatment head includes a member for supporting a brush roll, the brush roll having a plurality of floor treatment implements.

In one embodiment, the system further includes an adjustable spray outlet located on the body. In another embodiment, the system further includes a controller disposed on the body, and a sensor disposed on the body, whereby the controller is configured to identify which floor treatment head is attached to the body based on information received from the sensor. In operation, the controller is capable of controlling aspects of the adjustable spray outlet, the pump rate, and select the appropriate reservoir based on which floor treatment head is attached to the body.

Other variations, embodiments and features of the present disclosure will become evident from the following detailed description, drawings and claims.

DETAILED DESCRIPTION OF THE DISCLOSURE

It will be appreciated by those of ordinary skill in the art that the embodiments disclosed herein can be embodied in other specific forms without departing from the spirit or essential character thereof. The presently disclosed embodiments are therefore considered in all respects to be illustrative and not restrictive.

Figure 1A:
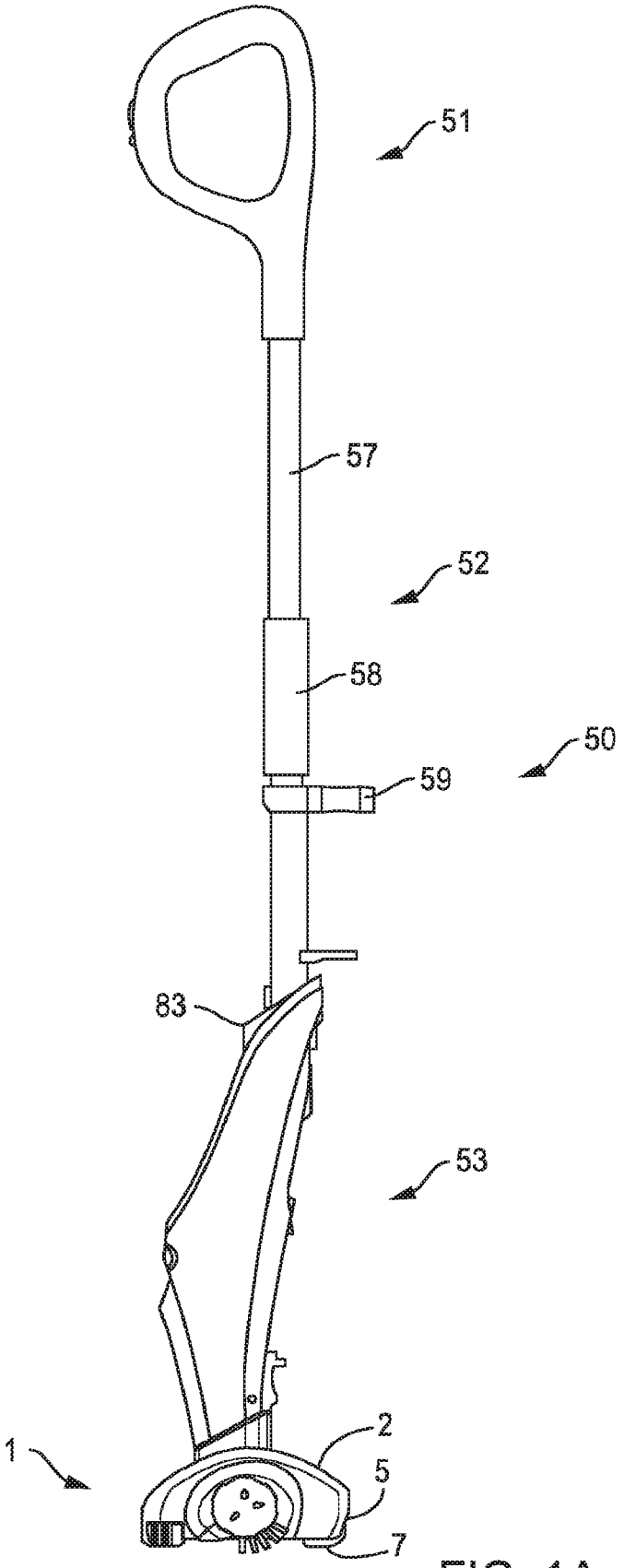
FIG. 1A is a side view of an appliance in accordance with an embodiment.

FIG. 1 depicts an illustrative embodiment of a cleaning appliance that may be used for cleaning or otherwise treating a floor surface, such as a carpet and/or hard floor. It should be appreciated that cleaning appliances described herein also may be used as treatment apparatuses that treat or operate on a surface to perform one or more functions other than cleaning. As illustrated, the cleaning appliance includes a swappable head 1, a body 50 and a handle portion 51. The head 1 is attached at a distal end of the body 50 and the handle portion 51 is attached at a proximal end of the body 50. As noted herein, a body or body portion of an appliance may refer to a part of the appliance that is suitable to engage or otherwise be coupled with a cleaning head, or treatment head. For example, a body or body portion of an appliance may be a pole, or a pole with a particular grip portion (e.g., handle) at the end or in the middle of the pole, an elongated housing, or a grip portion of a pole and/or housing, etc.

Figure 1B:
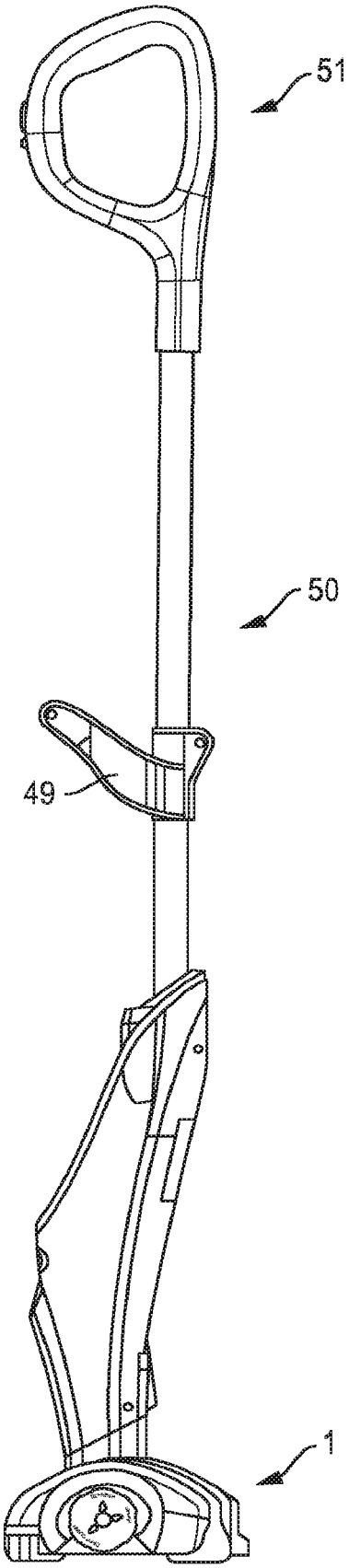
FIG. 1B is a side view of an appliance in accordance with an embodiment.
Figure 1C:
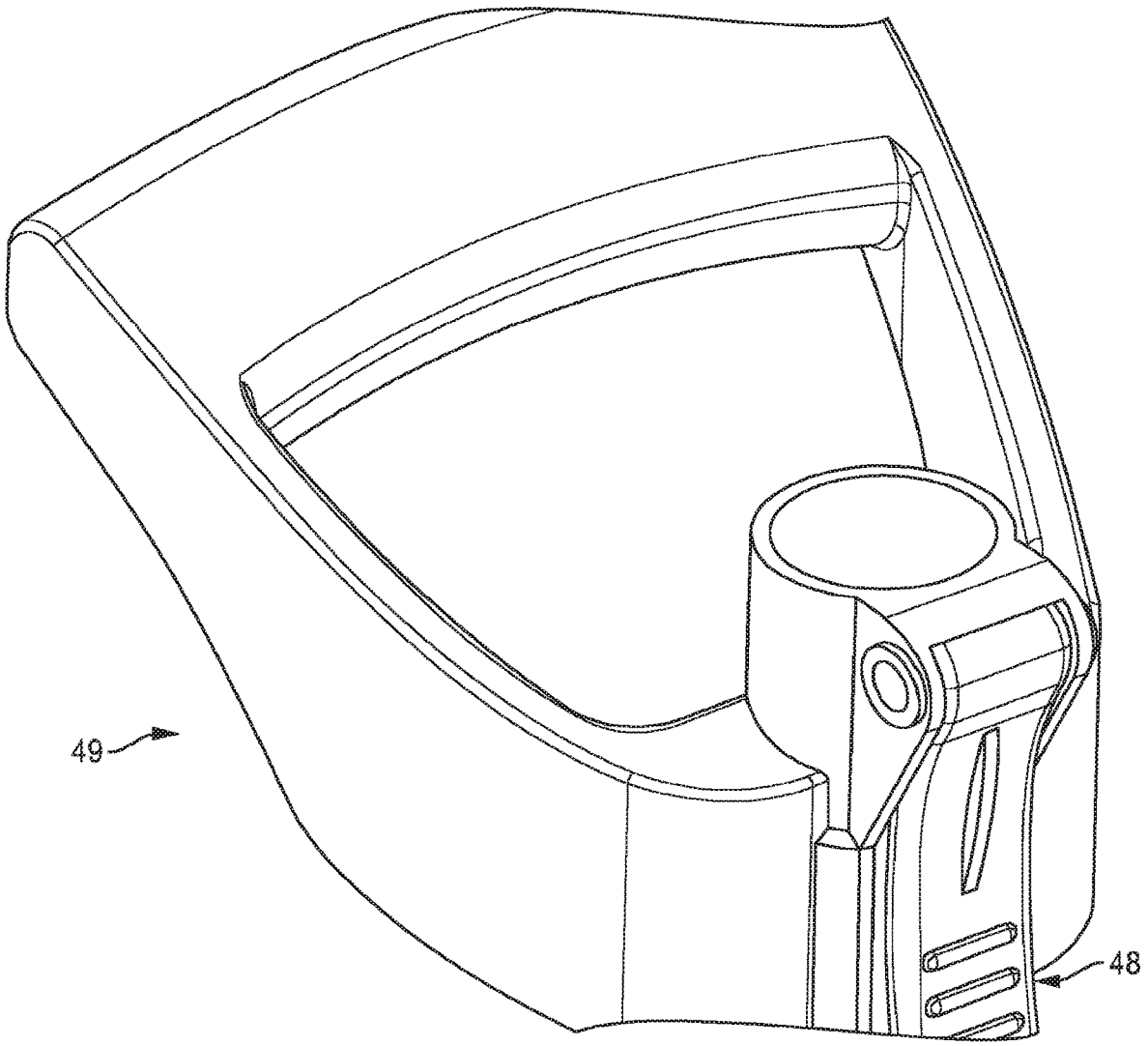
FIG. 1C shows an adjustable handle in accordance with an embodiment.

FIGS. 1B-1C depict an alternative embodiment of a cleaning appliance that includes a cleaning head 1, a body 50, a handle portion 51, and an adjustable handle 49. The adjustable handle 49 may include a locking lever 48 that allows the user to move the adjustable handle 49 up or down the body 50 and then lock it in place at the user's desired location. Any suitable type(s) of locking mechanism may be employed for locking the adjustable handle 49 to the body 50, depending on the desired use.

Figure 2A:
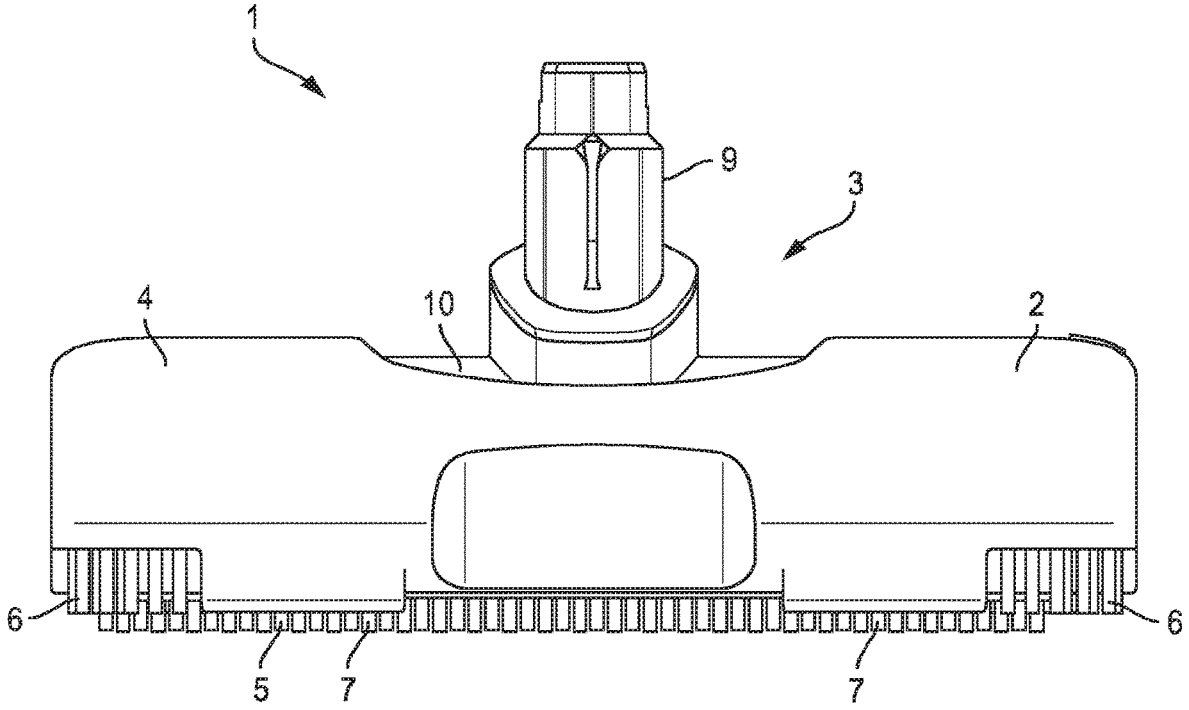
FIG. 2A is a front view of a treatment head in accordance with an embodiment.
Figure 2B:
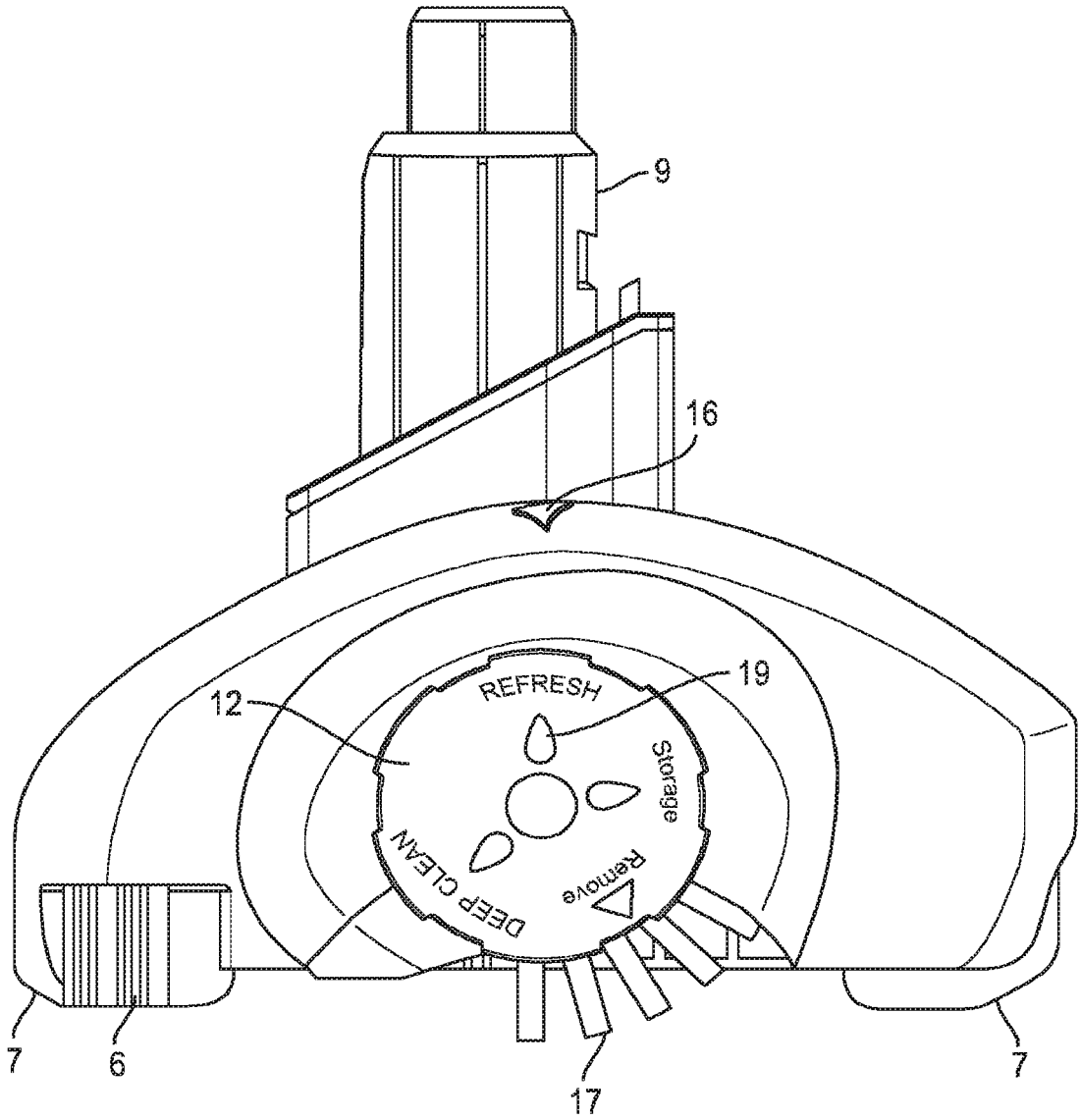
FIG. 2B is a partially cutaway side view of the treatment head of FIG. 2A.
Figure 2C:
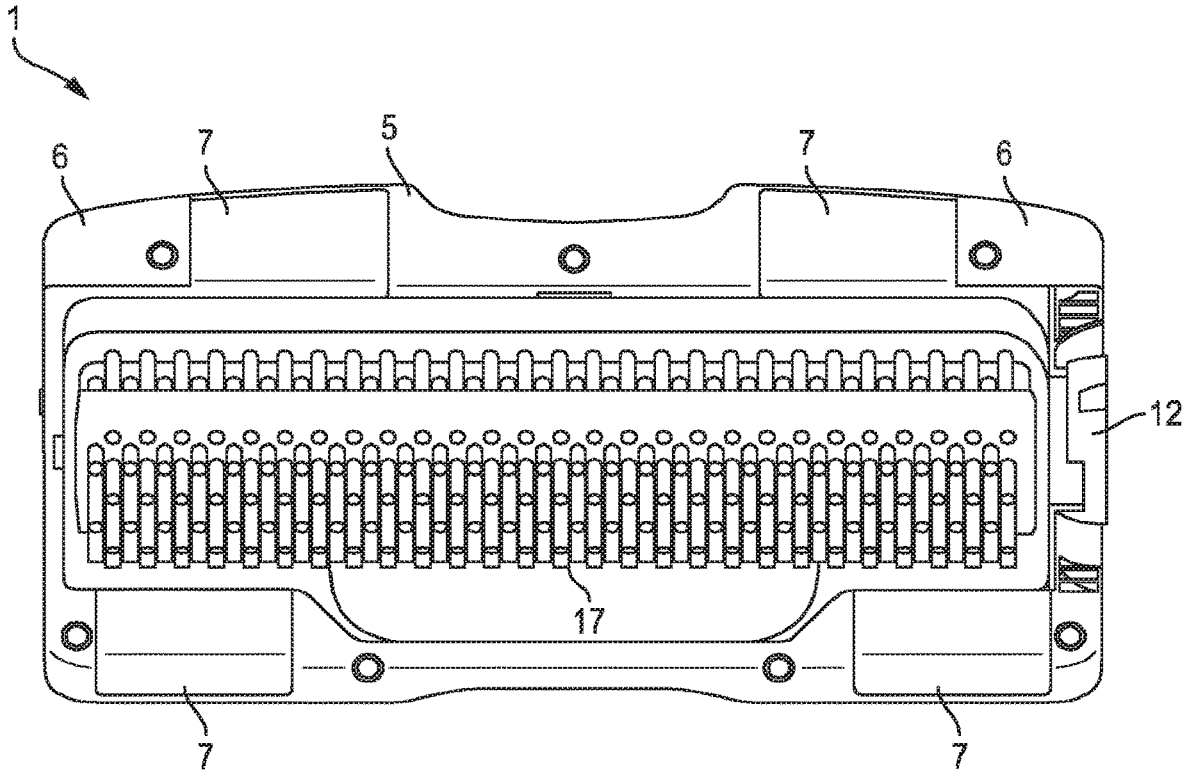
FIG. 2C is a bottom view of the treatment head of FIG. 2A.

FIGS. 2A-2C illustrate an embodiment of a cleaning head 1 that includes a base 2 and a yoke assembly 3. The base 2 may include a cover 4 that provides a housing or barrier for protecting components around which the cover is located. The base 2 includes a bottom portion 5 having sliders 7 that allow the cleaning head 1 to slide on the floor (e.g., carpet, hard floor). The sliders are a simple and inexpensive means of setting the correct datum for the cleaning head, and therefore the cleaning head bristles will have the correct engagement with the floor surface. In another embodiment, the base 2 may include wheels, or other rotating members, instead of sliders 7. Together, the cover 4 and bottom portion 5 form a yoke retainer 8 and a tracking rib 15, about which the yoke assembly 3 is able to rotate. The cover 4 has a marking feature 16 that points to an indication of the mode of selection (e.g., the type of cleaning implement selected) currently positioned for use by the appliance. The base 2 also includes bristles 6 located on the side of the bottom portion 5, which may provide brush coverage on the sides of the cleaning head 1 where bristles 17, extending from a supporting bar 11, are unable to reach. For example, the bristles 6 may be used to brush a difficult to reach area of a rug located in the corner of a room. In an alternative embodiment to using the bristles 6, a stiff pad or other cleaning material may be attached to the sides or corners of the bottom portion 22 of the cleaning head 1, in the same location where the bristles 6 are shown on in FIG. 2A.

The yoke assembly 3 is mounted to the base 2 via a yoke 10 and, in some cases, is allowed to rotate relative to the base 2. For example, the yoke assembly 3 may be attached to a body connector 9 which, in turn, may be attached to the body 50 which extends therefrom. Accordingly, a user may grip a portion of the body 50 (e.g., at the handle portion 51) and, during use, rotate the yoke 10 about the base 2.

The yoke assembly 3 may further include a supporting bar 11 having bristles 17 that extend therefrom. As shown, for example, in FIGS. 2D and 2C, the bar 11 may include multiple types of bristles 17A, 17B, grouped into brush sections. Any suitable type(s) of bristle may be employed for each particular brush section, depending on the desired use. The various types of bristles may have value for particular cleaning characteristics. For example, the bristles 17, or groups thereof, can have various lengths or all can have a single length, located in various patterns, made of various materials, have various diameters, and have various amounts per tuft. Or, it can be appreciated that, for other embodiments, cleaning or treating implements other than bristles or brushes may be used, for example, pads or other cleaning or treating implements. The yoke assembly 3 also includes an adjustment member 12, a bar retainer 13, an elastic member 18 and a sliding member 14.

As shown in the figures, the supporting bar 11 is mounted within the yoke 10, and is free to rotate relative thereto. The sliding member 14 is rotationally fixed within the supporting bar 11 and is fastened to the adjustment member 12. That is, the sliding member 14, the supporting bar 11 and the adjustment member 12 may be mutually coupled so as to rotate together as a unit.

In various embodiments, a support for movably positioning one or more cleaning implements in contact with a floor, while keeping one or more other cleaning implements away from contact with the floor, is not required to be in the form of a supporting bar. That is, other suitable support members, other than a supporting bar, may be used for appropriate positioning of the cleaning implement(s), for example, via rotation, translation, tilting, etc.

Figure 3:
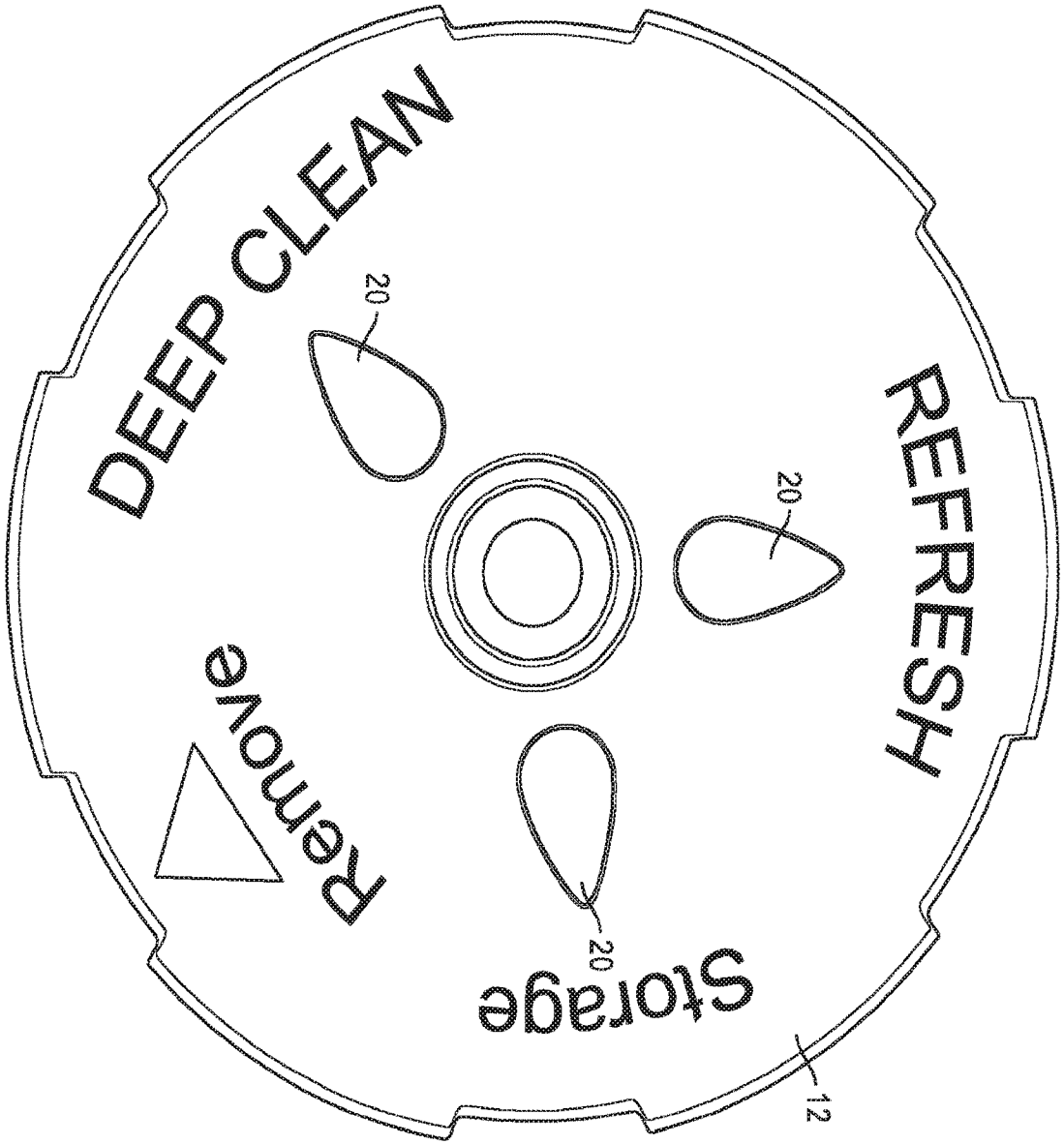
FIG. 3 shows an adjustment member in accordance with an embodiment.

As shown in FIG. 3, the adjustment member 12 is provided as a knob having four positions. Here, the first position is referred to as a storage position. The second position is referred to as a remove position. The third position is referred to as a refresh position. The fourth position is referred to as a deep clean position. In one embodiment, the adjustment member 12 may include a knob having three positions. Here, the first position can be referred to as whole carpet position. The second position is referred to as high traffic and stain position. And the last position is referred to as a storage position. The adjustment member 12 may be removed by pulling and rotating the knob. Although three and four positions are disclosed, it should be understood that the adjustment member 12 may have more or fewer positions.

In each of the positions, except for the remove position, the adjustment member 12 is keyed to a bar retainer 13 by a boss 19 into one of three openings 20 which each coincide with a corresponding position. In this embodiment, respective openings 20 correspond to the first position, the third position, and the fourth position. In addition, the bar retainer is optionally fixed to the yoke 10.

Figure 2D:
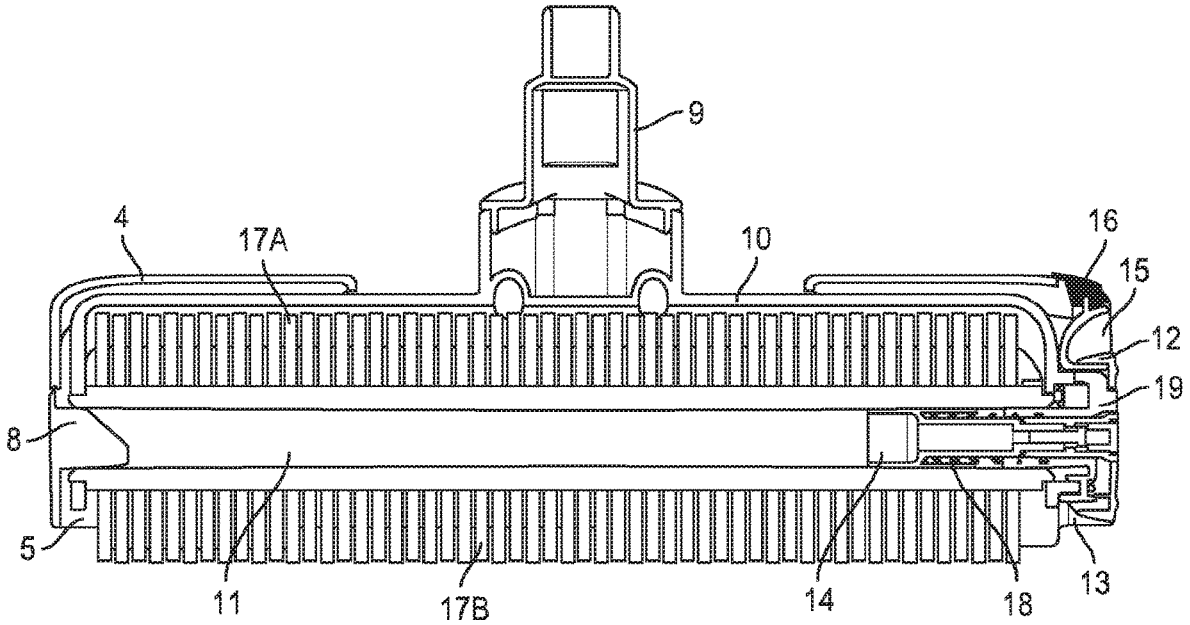
FIG. 2D is a cross-sectional view of the treatment head of FIG. 2A.
Figure 2E:
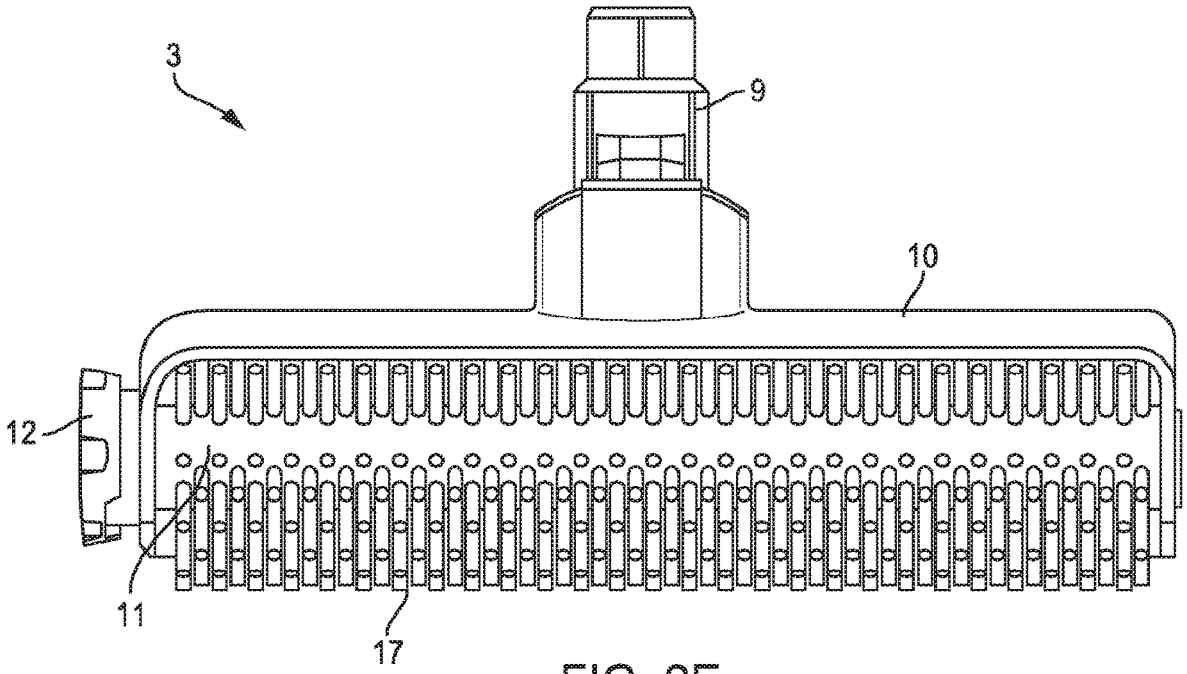
FIG. 2E shows a floor treatment implement support with attached bristles according to one embodiment.

An elastic member 18 (e.g., spring) biases the adjustment member 12 inward toward the supporting bar 11 so that the adjustment member 12 is placed into one of the positions provided by the openings 20. As shown in FIG. 2D, the supporting bar 11 is positioned, in cooperation with the adjustment member 12, such that a group of a first type of bristles 17A is oriented toward the bottom of the head, so as to be placed in contact with the floor during use of the appliance.

In order to change positions, the adjustment member 12 is pulled away from the base 2 and rotated along the tracking rib 15 so that the desired opening 20 is aligned with the boss 19. By rotating the adjustment member 12, the group of the first type of bristles 17A is moved away from the bottom of the head, and a group of the second type of bristles 17B may be moved into an orientation, toward the bottom of the head, suitable for cleaning. The adjustment member 12 is then released so as to allow the bias provided by the elastic member 18 to pull the adjustment member 12 back on to the boss 19 such that the boss 19 is inserted into the opening 20 corresponding to a preferred position. Accordingly, for various embodiments, the type of bristles, or other suitable cleaning implements, may be selected as desired.

When the adjustment member 12 is placed in the first position, referred to as a storage position, the bristles 17, or other cleaning implement(s), may be retracted or otherwise removed from contact with the floor. It may be desirable for various cleaning implements to be retracted from the floor so as to minimize or reduce any potential damage to the floor, objects to which they come into contact, or the cleaning implements themselves.

When the adjustment member 12 is placed in the remove position, in this embodiment, the yoke assembly 3, and components associated therewith (e.g., supporting bar, cleaning implement(s), adjustment member), are removable from the base 2. Removal of the yoke assembly 3, and associated components, may be desirable, for example, for cleaning or maintenance thereof. In some embodiments, various components, such as the supporting bar, the cleaning implements, and the adjustment member may be removable.

Figure 4A:
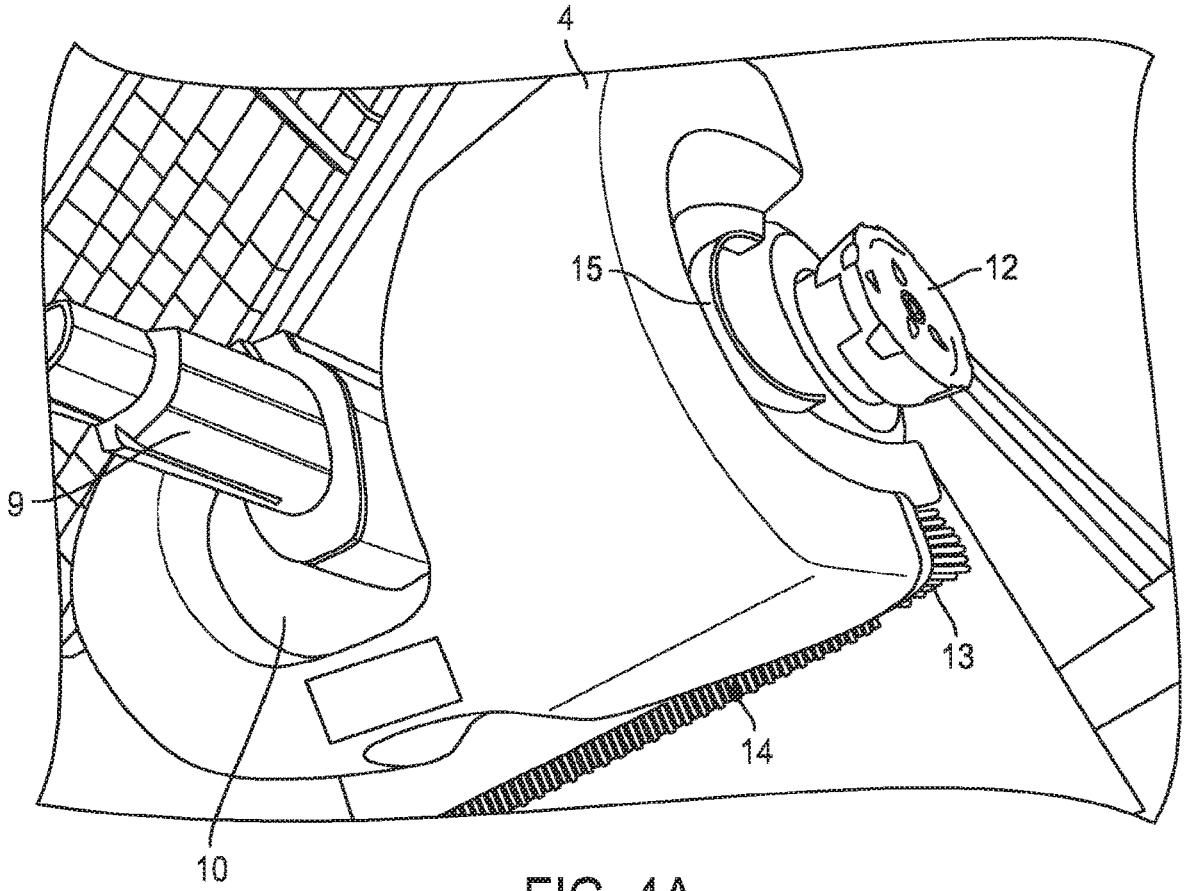
FIG. 4A shows a floor treatment implement support being assembled with a treatment head in accordance with an embodiment.
Figure 4B:
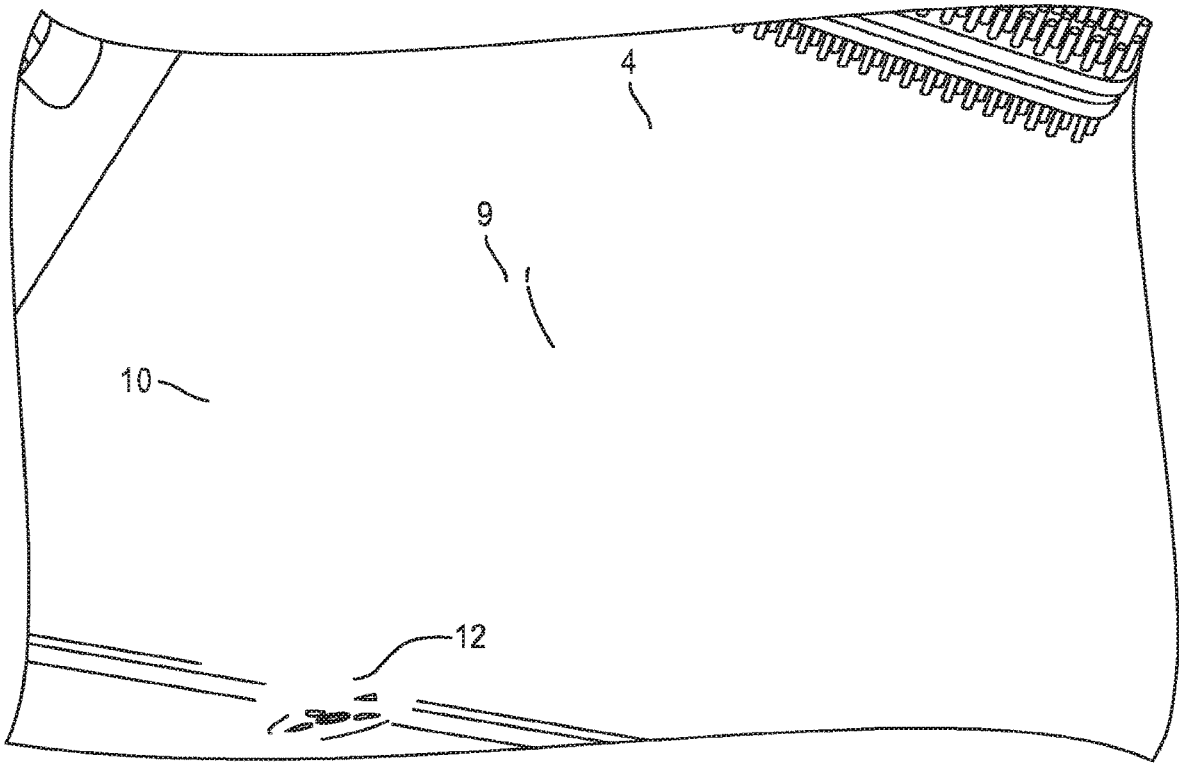
FIG. 4B shows the floor treatment implement support of FIG. 4A separated from a cover of the floor treatment head in accordance with an embodiment.
Figure 5A:
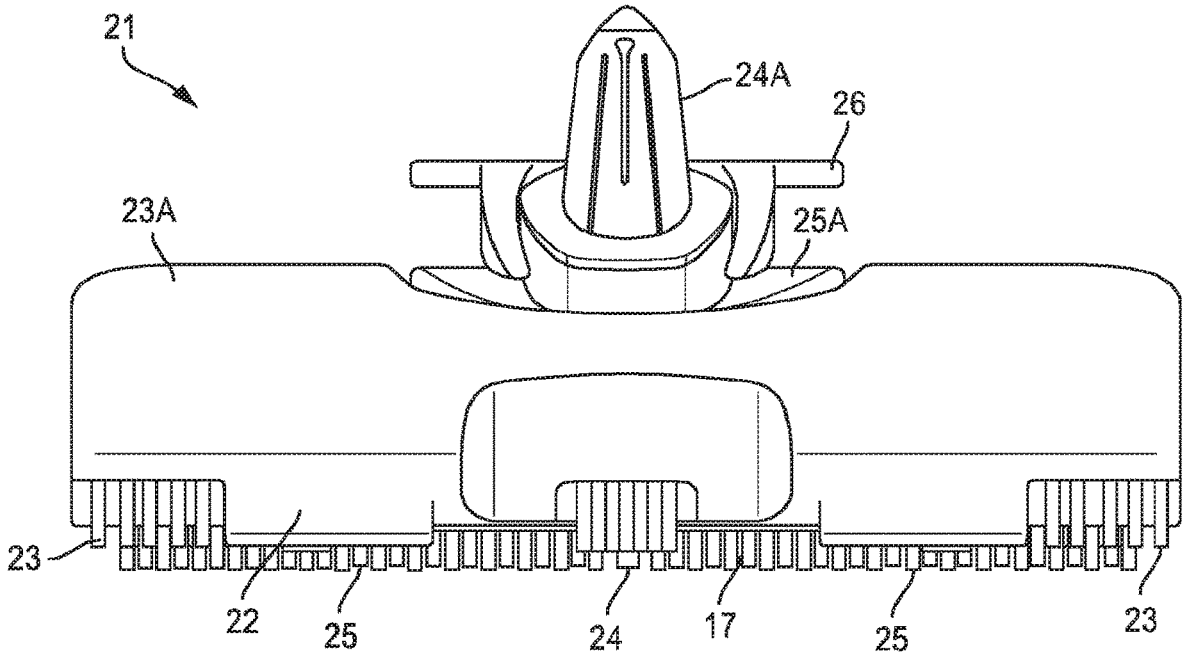
FIGS. 5A-5C are various views of another treatment head in accordance with an embodiment.
Figure 5B:
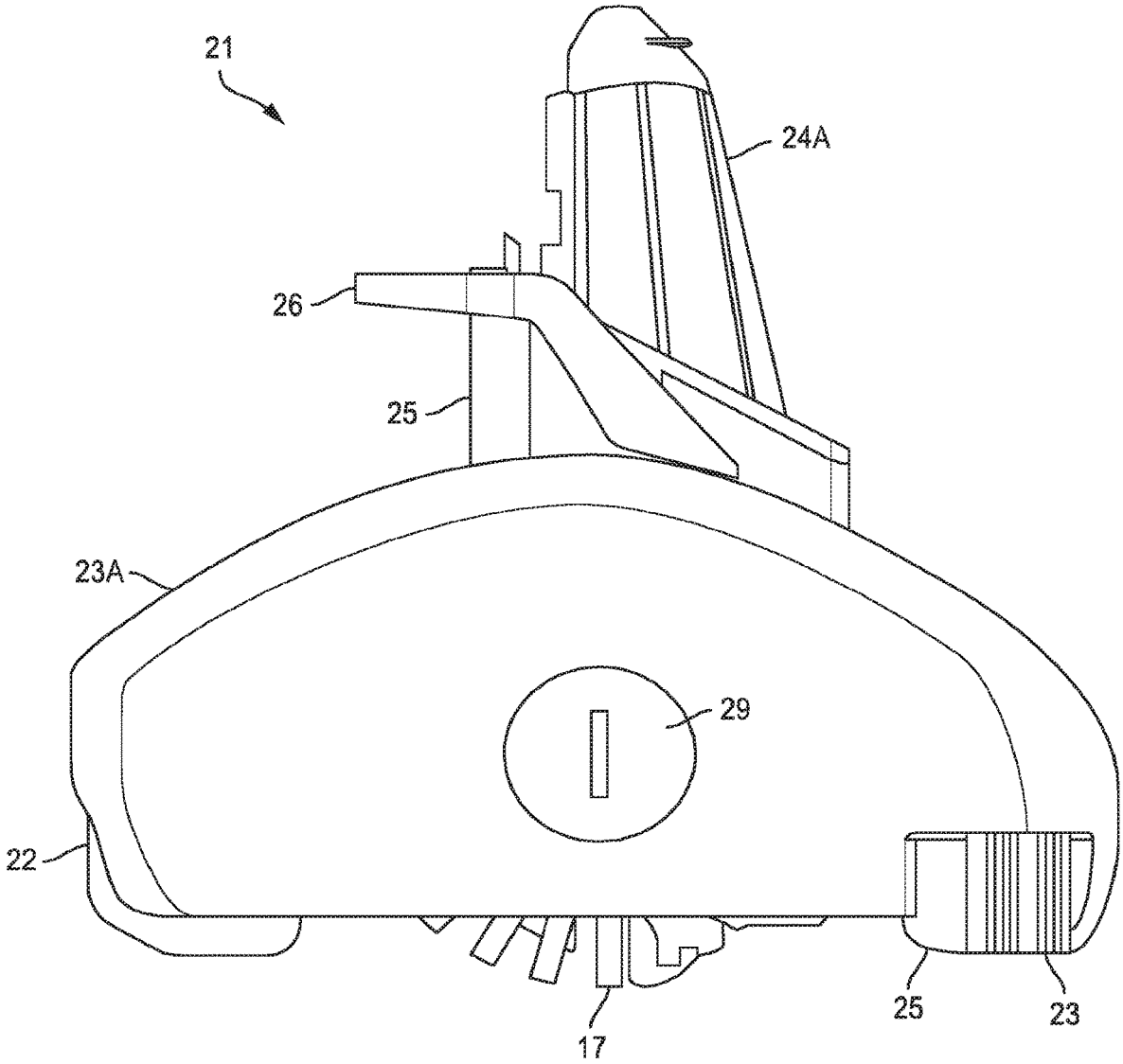
Figure 5C:
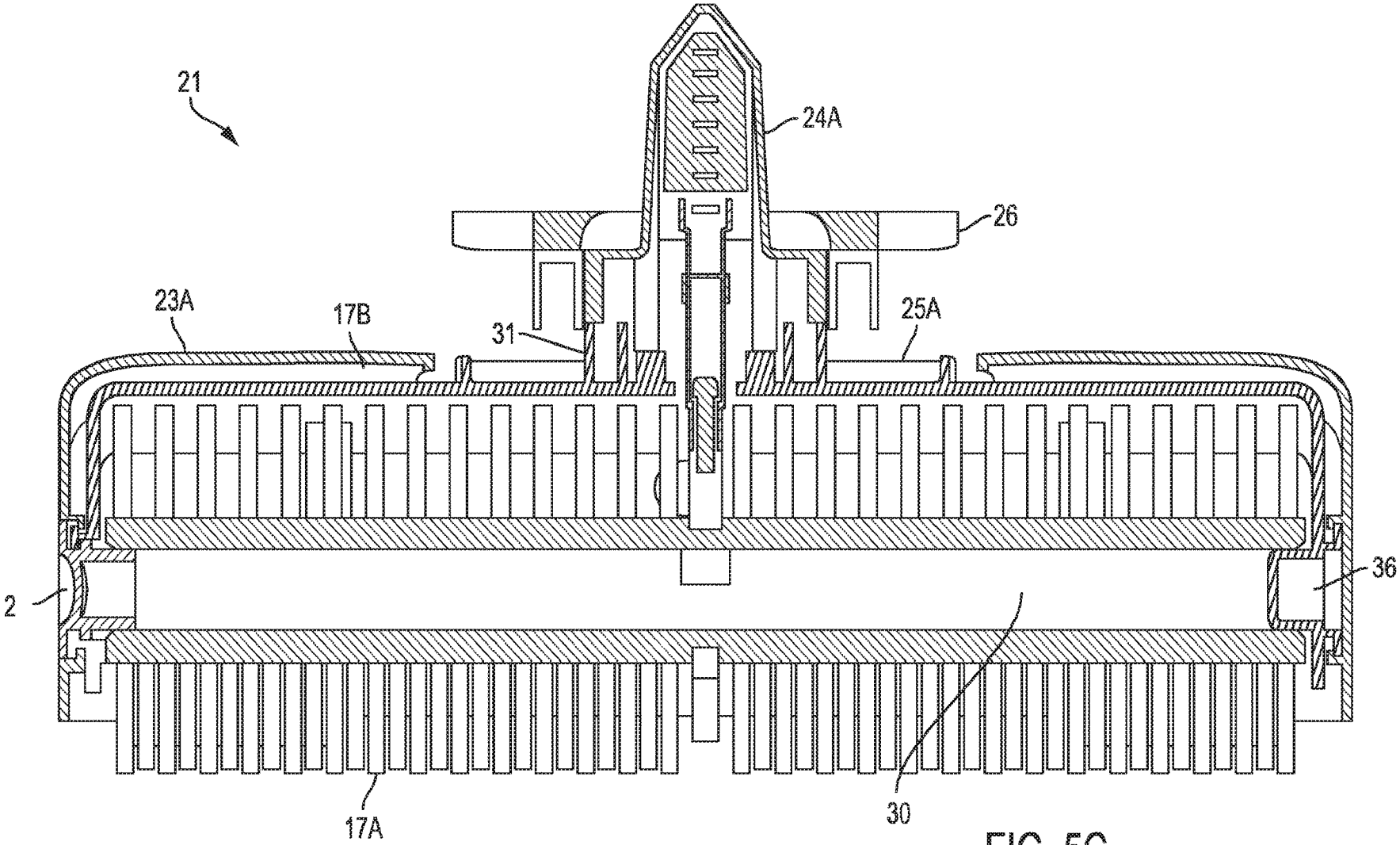

When adjusting between positions, the knob of the adjustment member 12 is rotated along the tracking rib 15. Though, here, to remove the yoke assembly 3, the adjustment member 12 is aligned with the appropriate marking feature 16 and pulled away further than in the case of changing between positions, allowing the adjustment member to become disengaged from the tracking rib 15, as shown in FIG. 4A. Once the adjustment member 12 is pulled away from the tracking rib 15 and also disengaged from the yoke retainer 8, the yoke assembly 10, together with the body connector 9 and supporting bar 11, with associated bristles 17A, 17B, may be removed from the cover 4. To reinstall, the supporting bar 11 is suitably aligned with the yoke retainer 8 and pressed back into position.

In an alternate embodiment, there is no second position, and the yoke assembly 3 can be removed with the adjustment member 12 in any orientation by pulling the knob further out as compared to simply changing positions, allowing the knob to become disengaged from the tracking rib 15. When the adjustment member 12 is placed in the third position, referred to as a refresh position, as discussed above, a selected group of bristles may be placed in a suitable orientation that is below the sliders 7, so as to contact the underlying floor. When the adjustment member 12 is placed in the fourth position, referred to as a deep clean position, a different set of bristles may be used to engage with the floor. It should be appreciated that any suitable number of positions may be employed so as to engage various sets of bristles, or other suitable cleaning implements, with the floor.

In one embodiment, when the adjustment member 12 is placed in the whole carpet position, a first selected group of bristles may be placed in a suitable orientation that is below the sliders 7, so as to contact the underlying floor. In another embodiment, when the adjustment member 12 is placed in the high traffic and stain position, a second selected group of bristles may be placed in a suitable orientation that is below the sliders 7, so as to contact the underlying floor. In some instances, the first selected group of bristles may have more bristles per tuft than the second selected group of bristles. In other instances, the second selected group of bristles may have thicker and stiffer bristles than the first selected group of bristles. It will be appreciated by one skilled in the art that these are mere examples of the types of bristles that may be used and that other bristle configurations may be utilized depending on the type of surface the cleaning head is to be engaging.

When the adjustment member 12 is placed in the storage position, the two selected groups of bristles are placed in a suitable orientation such that all the bristles are above the slides 7, so that no bristles can engage the underlying floor. It should be appreciated that any suitable number of positions may be employed so as to engage various sets of bristles, or other suitable cleaning implements, with the floor.

FIGS. 5A-5C and 6A-6C depict another illustrative embodiment of a swappable cleaning head that provides for selection from among various cleaning implement settings. As shown, the cleaning head 21 has a bottom portion 22 that includes side bristles 23, center bristles 24 and sliders 25. The side bristles 23 may provide brush coverage on the sides of the cleaning head 1 where bristles 17, extending from a supporting bar 11, are unable to reach. The head 21 further includes a cover 23A for housing various components underneath, for example, a yoke 25A and a supporting bar 30 with bristles 17 extending therefrom. The head 21 also includes a body connector 24A for attaching or otherwise coupling a portion of the body 50 thereto. The head 21 further includes a pedal 26, a removal screw 29, and a changing mechanism 27.

Here, while not a required feature for every embodiment described herein, the body connector 24A is fastened to the yoke 25A. The pedal 26 may be mounted between the body connector 24A and yoke 25A, and may be allowed to pivot about an axis. Changing mechanism 27 may be mounted within the cavity formed by the body connector 24A and yoke 25A. The changing mechanism 27 includes a pin 31, a sliding housing 32 that includes a sliding latch 33 and an elastic member 34, and an elastic member 35 that biases the changing mechanism 27 against the body connector 24A. The yoke 25A may be mounted between the bottom portion 22 and cover 23A of the head 21 and may be allowed to pivot about its own axis. The supporting bar 30 may be mounted on the same axis as the yoke 25A, for example, via a boss 36 and/or a removal screw 29.

The supporting bar has bristles 17, rolling bumpers 40, and a center cam 28. When the supporting bar is released and able to rotate (i.e., when the pin 31 is moved away from the recess of the supporting bar 30), and the appliance is moved across the floor, the rolling bumpers 40 may provide sufficient structure from which the floor may cause rotation of the supporting bar 30, and bristles extending therefrom. That is, without the rolling bumpers 40, contact of the bristles themselves with the floor may be insufficient for the supporting bar and bristles to change position.

Similar to the above embodiment, the supporting bar 30 may have multiple types of cleaning implements, in this case, bristles 17A, 17B. Accordingly, the supporting bar 30 may be placed in at least two positions, each position corresponding to a respective type of bristle. To remove the supporting bar 30 from the cleaning head 21, the removal screw 29 may be disengaged so as to release the supporting bar 30 from the yoke 25A. This arrangement is in contrast to the embodiment of FIGS. 2A-4B above where the supporting bar and yoke are attached to one another, so as to be removed and installed to the cover together. However, it can be appreciated that various components in accordance with the present disclosure may be installed separately or together.

In this embodiment, the pedal 26 has a first end 26A, for actuation by a user, and a second end 28A, that operates on the sliding housing 32. Accordingly, the pedal 26 has two positions. The first position is referred to as a rest position. The second position is referred to as an active position.

Figure 6A:
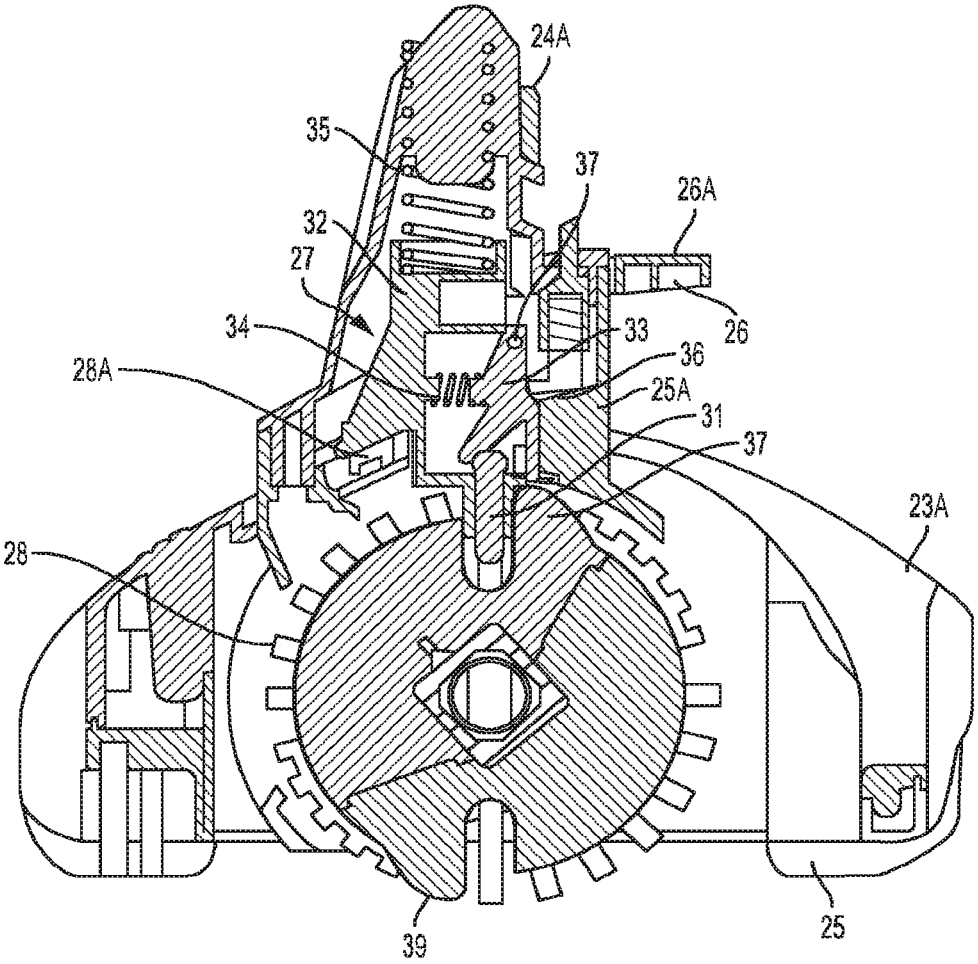
FIGS. 6A-6C are various cross-sectional and cutaway views of a treatment head in accordance with an embodiment.

The pin 31 may slide relative to the sliding housing 32 against the sliding latch 33. The sliding latch 33 is rotatable about a pin 37 and is biased against the sliding housing 32 by the elastic member 34. In FIG. 6A, the pedal 26 is shown to be at rest, that is, not in a depressed state. Here, the pin 31 resides within the recess provided by the supporting bar so as to impede rotation of the supporting bar.

Figure 6B:
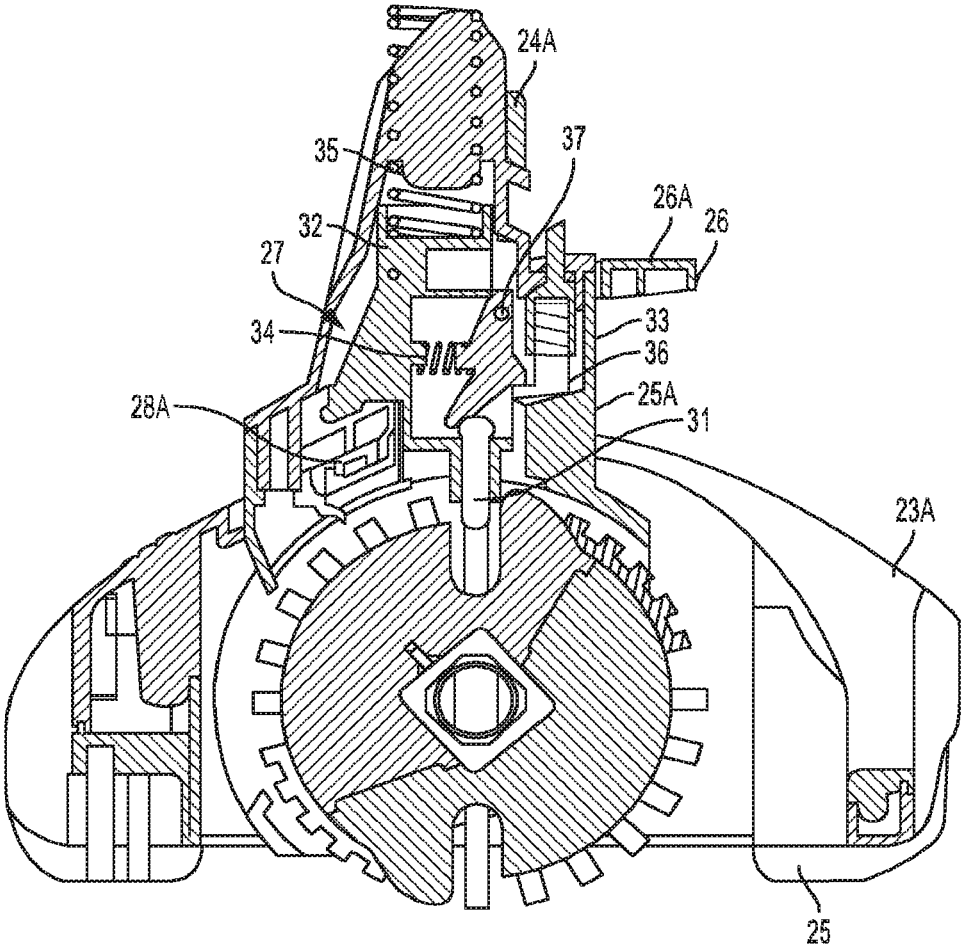
Figure 6C:
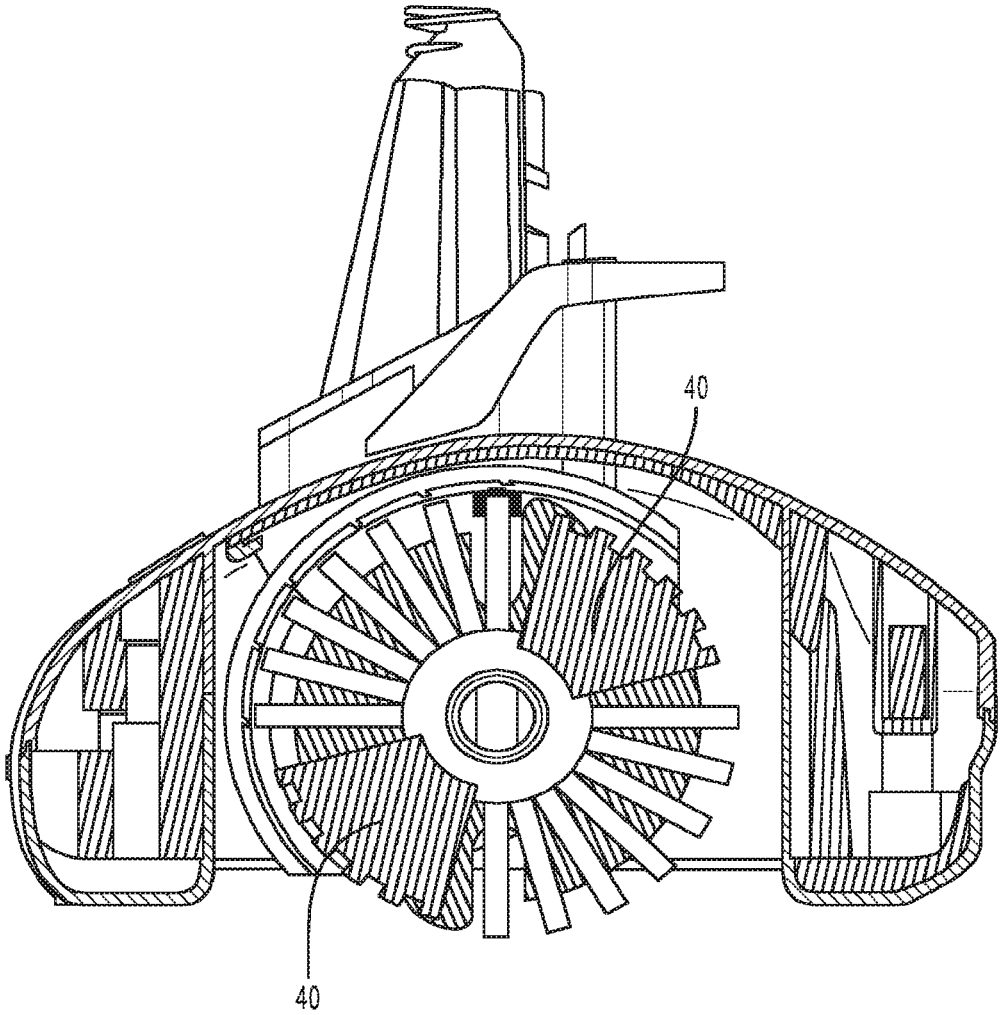

To change from one position on the supporting bar 30 to another to change between types of cleaning implements, the pedal 26 is put into the second position, as shown by FIG. 6B, raising the second end 28A against the sliding housing 32. This movement causes the sliding housing 32 to move into a raised position. In this raised position, the elastic member 34 pushes the sliding latch 33 over the upper surface of the shelf 38, so as to substantially prevent the sliding housing 32 from returning to its original, lowered position.

At this point, the supporting bar 30 is released. The user then moves the appliance across the floor, which causes rotation of the supporting bar, hence, changing the bristles. As the user moves the appliance in a direction that causes the supporting bar to continue rotation, the supporting bar 30 rotates until the pin 31 reaches a hump 39 on the cam 28, after having moved over the rolling bumpers 40. As the pin 31 moves over the hump 39, the pin 31 moves in a vertical direction, which causes the sliding latch 33 to release from the shelf 38. Once the sliding latch 33 moves off of the shelf 38, the pedal 26 is returned to the rest position, while keeping the supporting bar and associated bristles in the adjusted position.

In some embodiments, the body may have one or more spray outlets that draw liquid (e.g., cleaning liquid) from respective reservoirs. The one or more spray outlets may have a fixed or adjustable spray nozzle to provide a fixed spray coverage area or a range of spray coverage areas. In another embodiment, the one or more spray outlets may be located on the cleaning head 1. The body may be further configured so as to separately control each spray outlet, hence, the type and/or amount of liquid that is applied to the floor from the spray outlet.

Figure 7A:
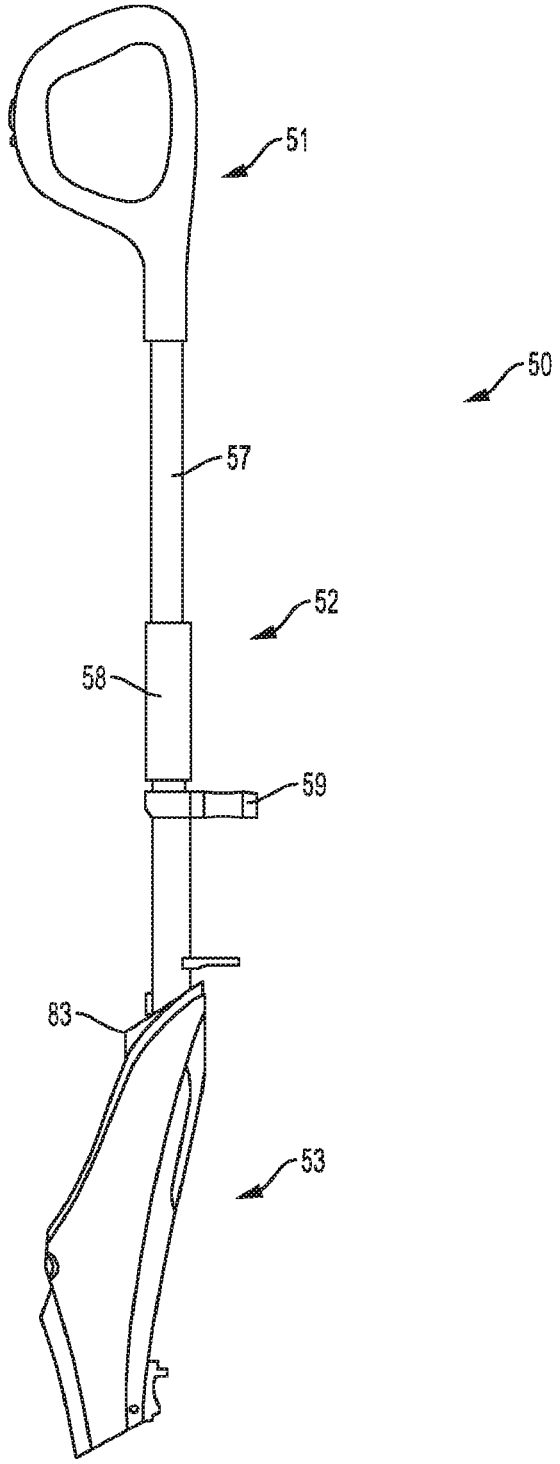
FIG. 7A is a side view of an appliance body in accordance with an embodiment.
Figure 7B:
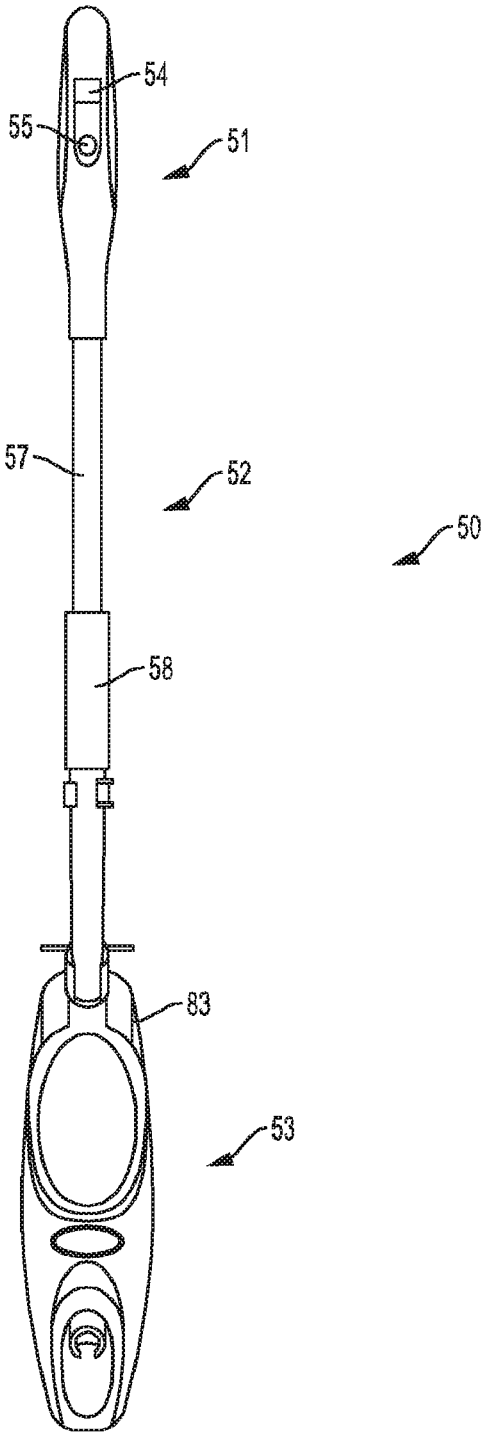
FIG. 7B is a front view of the appliance body shown in FIG. 7A.
Figure 8:
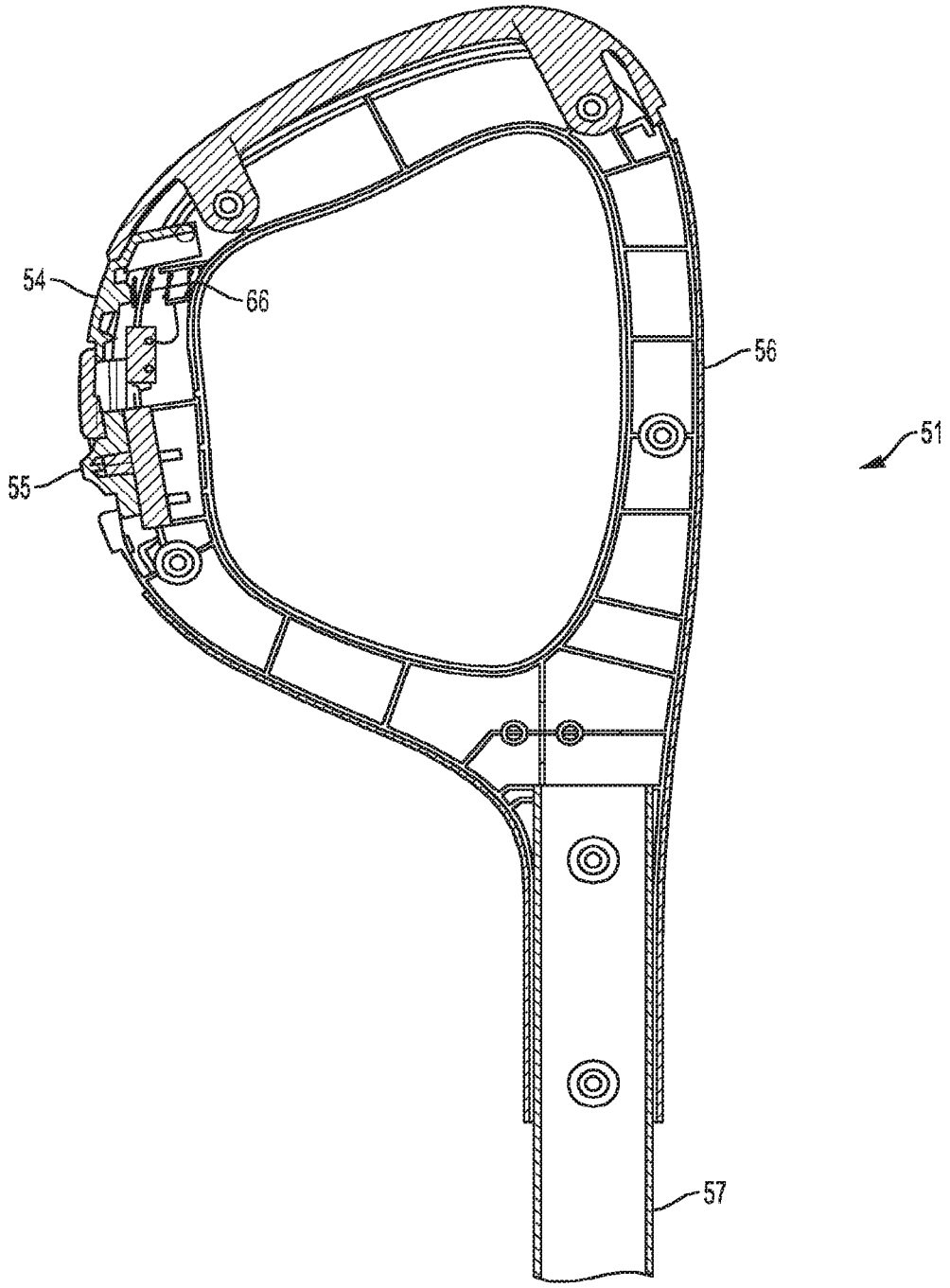
FIG. 8 is a side view of a handle portion of an appliance in accordance with an embodiment.

As shown in FIGS. 7A-7B and 8, the body 50 has a handle portion 51, a pole portion 52, and a body portion 53. The handle portion 51 includes a trigger 54, a selector switch 55, and a handle body 56. The pole portion 52 has one or more conduits 57 for providing communication (e.g., electrical/mechanical control) and/or mechanical support/coupling between the handle portion 51 and the body portion 53. The pole portion 52 also may have a foam grip 58 and/or a spray bottle clip 59.

As shown in FIGS. 9 and 10A-10C, the body portion 53 may have a back cover 60, a housing 61, a bottle housing 62, a bottle lock mechanism 63, a spray assembly 64, a mop-head release mechanism 69, and liquid pumps 65. The handle body 56 may be mounted (e.g., rigidly attached) to the top most conduit 57.

The body portion 53 may include multiple spray outlets (e.g., nozzles) that are arranged to spray a liquid (e.g., water or a liquid containing cleaning additive) onto the floor. In some embodiments, the spray outlets may be separately controllable to release liquid. That is, a trigger 54 on the handle portion 51 may be configured to control release of liquid from one spray outlet on to the floor, separate from the other spray outlet. For example, in a particular instance, it may be desirable for cleaning liquid from two spray outlets to be applied to the floor at the same time, or it may be desirable for cleaning liquid from only one of the two spray outlets to be applied to the floor at a time.

As discussed above, the trigger 54 may be mounted on the handle body 56, and may have multiple positions. In a first position, the trigger may be at rest, while in a second position, the trigger may be active. As shown, the trigger 54 may be biased to the rest position by an elastic member 66. In the active position, the trigger turns on one or more pumps 65 to spray liquid out of the spray assembly 64.

In some embodiments, also mounted in the handle body 56 may be a selector switch 55. The selector switch 55 may have multiple positions. In a first position, the selector switch 55 may provide for activation of a single pump 65. In a second position, the selector switch 55 may provide for activation of both the first and second pump 65. In a third position, the selector switch 55 may provide for activation of more than two pumps 65.

In an alternate embodiment, there could be no selector switch 55. For example, a single spray setting may be provided where one or more pumps are activated when the trigger is depressed. In some embodiments, pulling the trigger, pressing a button, or another user force provides the force used to actuate a manual pump.

The foam grip 58 may be mounted to one of the conduits 57. The foam grip 58 also may be adjustable along the length of a conduit 57. The bottle clip 59 can be mounted to one of the conduits 57, for example, via a snap fit to a conduit 57 and, thus, may be removable.

The lowermost conduit 57 may be mounted to the body section 53 in a tube cavity 67. The back cover 60 may be fastened or otherwise coupled to the housing 61 including, for example, a battery tray 68 and/or a battery tray cover 70. The spray assembly 64 may be mounted to the housing 61 and may include one or more spray nozzles 71, an LED 72, and one or more check valves 73. In an alternative embodiment, the spray assembly 64 and spray nozzles 71 may be located on any of the cleaning heads. The bottle housing 62 may be fastened to the housing 61 and may include a bottle receptacle 74. The bottle lock mechanism 63 also may be mounted to the bottle housing 62.

Figure 9A:
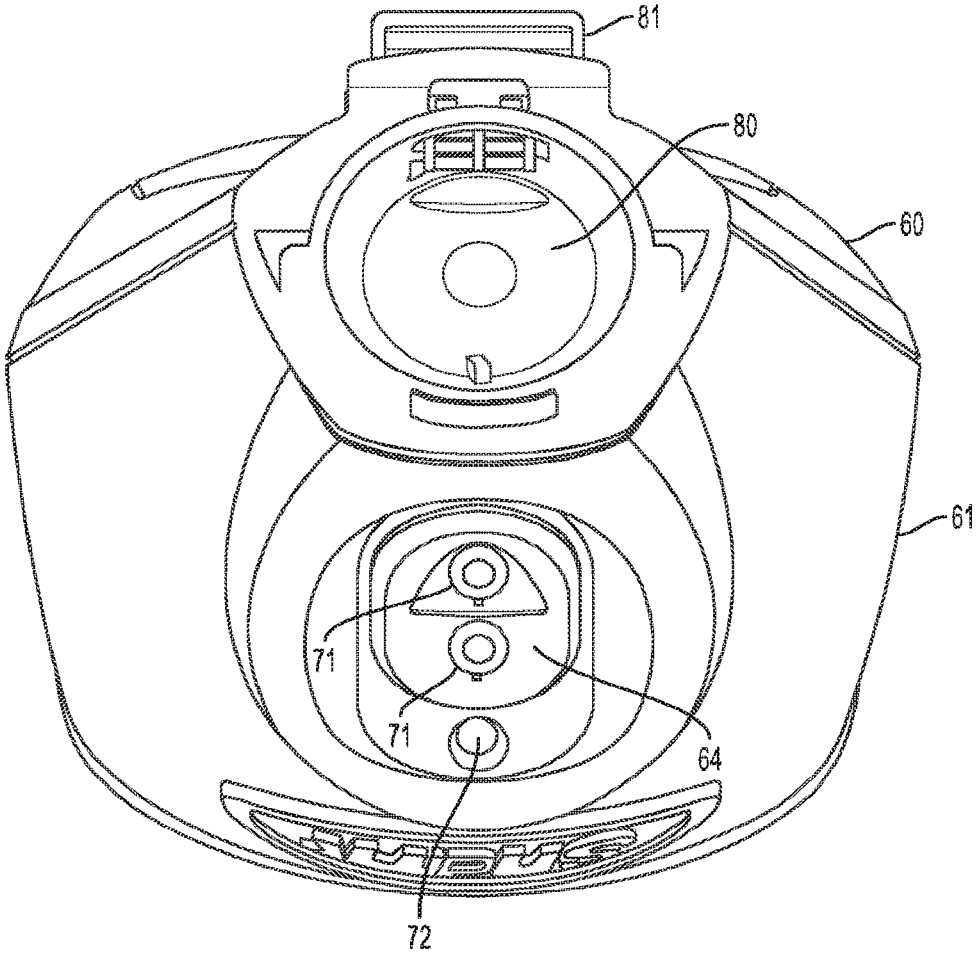
FIG. 9A is a top view of a portion of an appliance body in accordance with an embodiment.
Figure 9B:
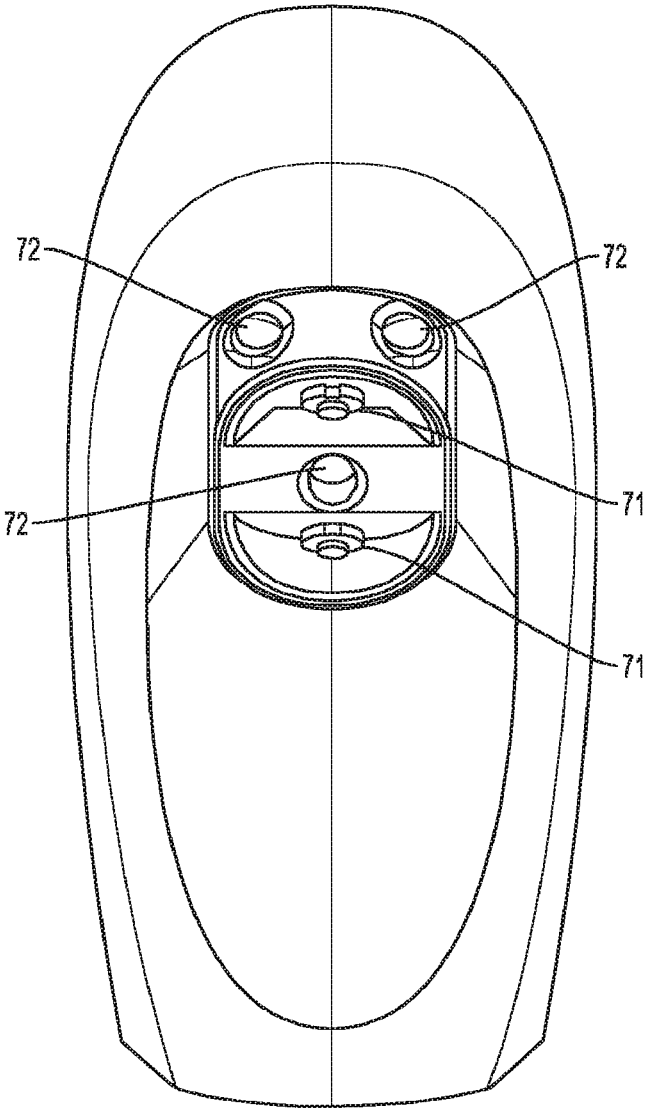
FIG. 9B is a front side view of a portion of an appliance body in accordance with an embodiment.

FIG. 9B shows an alternative embodiment of a portion of the appliance body including three LED lights 72, however, any number of LED lights or any other type of light may be included on this appliance. This embodiment also includes two spray nozzles 71.

Figure 10A:
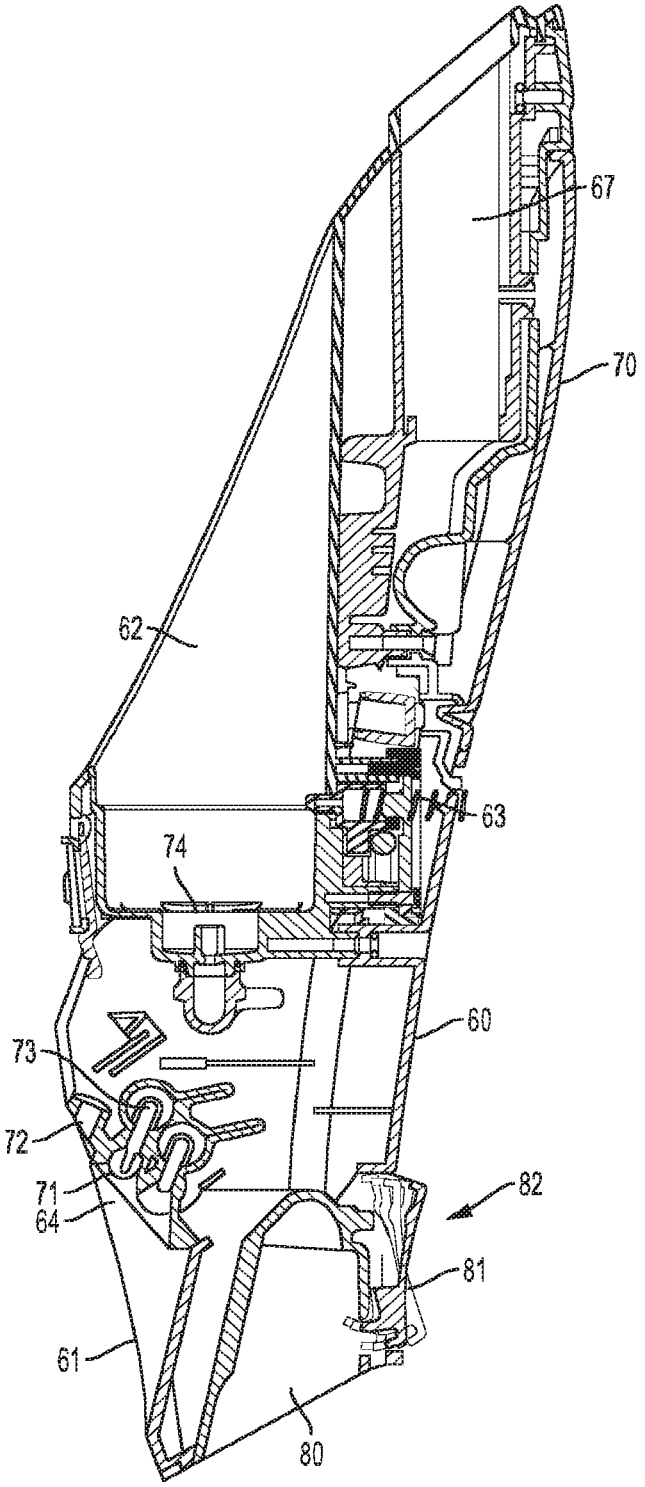
FIGS. 10A-10D are various views of a portion of an appliance body in accordance with an embodiment.
Figure 10B:
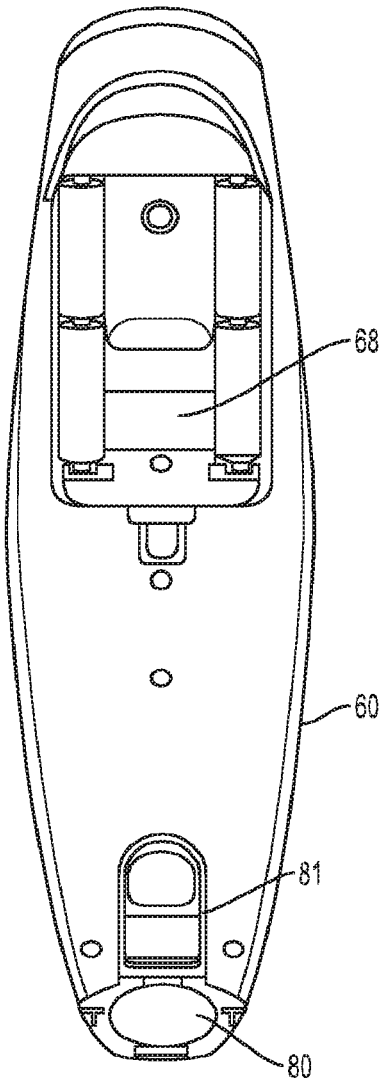
Figure 10C:
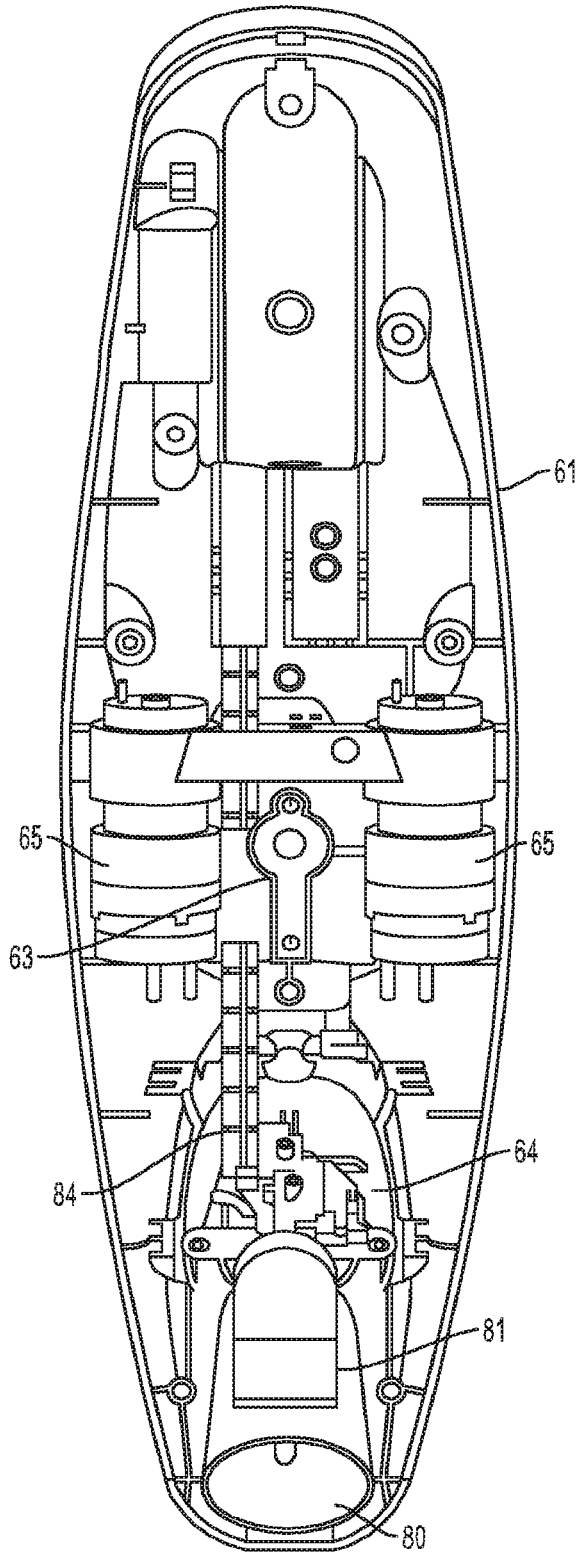

As shown in FIGS. 10A-10C, the housing 61 may further have a head connector 80 that mates to a body connector from among a plurality of swappable cleaning heads or other treatment heads. The release mechanism 69 may control this connection and have a bottom latch 81 that is biased in the latched position by an elastic member 82. The release mechanism also may include a top button 83 that is connected to the bottom latch 81, for example, via a rod 84. Either the top button 83 or the bottom latch 81 may be used to release any cleaning or treatment head from the body 50.

Figure 14:
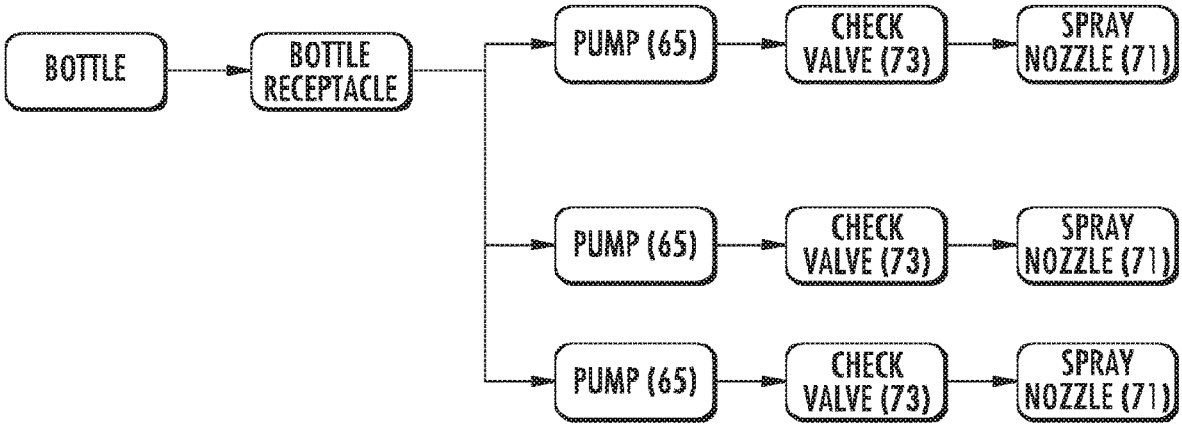
FIG. 14 is a flow chart that is an illustrative embodiment of a fluid path in an embodiment which includes three pumps and three spray nozzles.

The flow chart provided in FIG. 14 is an illustrative embodiment of a fluid path in an embodiment which includes three pumps and three spray nozzles, though of course, fewer or a greater number of pumps and spray nozzles may be used.

Multiple spray outlets 71 may be provided for various spray patterns. When the selector switch 55 is in a single pump position, one spray outlet 71 may provide a localized, mop-head-width spray. When the selector switch 55 is in a dual pump position, one spray nozzle 71 may provide the same localized, mop-head-width spray; and an additional spray nozzle 71 may provide a wider, relatively dispersed spray. This arrangement allows a user to select a desired spray pattern for each application.

In an alternate embodiment, there is no selector switch 55, and the number of pumps 65 and spray outlets 71 which are activated is controlled by which cleaning or treatment head is connected to the body 50. Accordingly, for some embodiments, the body portion 53 may be able to accommodate multiple different types of cleaning heads. For example, a first cleaning head having various cleaning bristles may be removably attachable to the body portion, and a second cleaning head having a cleaning pad may be removably attachable to the same body portion instead of the first cleaning head.

Further, the body may include a sensor and controller arrangement (e.g., a controller including a microprocessor) that is adapted to identify which cleaning head is attached to the body portion based on information from the sensor. For example, the cleaning head may have a particular attachment configuration, identification marker, or other feature(s) that allows the sensor and controller to determine what type of cleaning head is attached to the body.

Figure 13A:
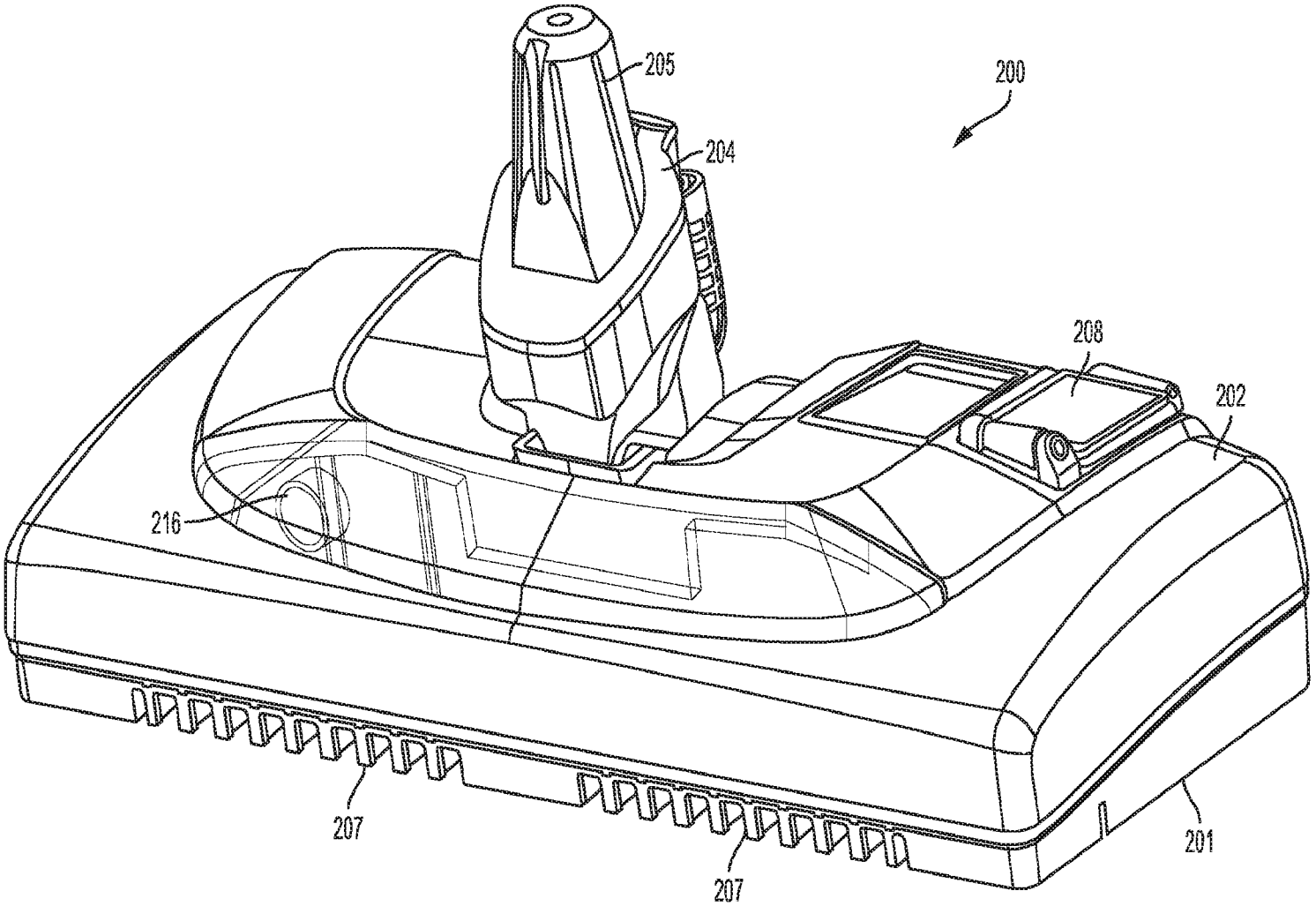
FIGS. 13A-13E are various views of a treatment head in accordance with an embodiment.

In one embodiment, head connector 80 may include a sensor system 85, and a controller 82 may be communicatively connected to the sensor system 85. The sensor system 85 may be configured to detect the identity of a head of the present disclosure when it is connected to the body 50, and the controller 82 may be configured to selectively activate, based on the identity of the connected head, at least one of the pumps 65. It is to be appreciated that the sensor system 85 may be configured in a variety of ways. In an exemplary embodiment, as illustrated in FIG. 10C, the sensor system 85, may include electrical-mechanical switches 86 configured to detect the identity of the connected head. For example, each electrical-mechanical switch 86 may be configured to be triggered by only one of the swappable heads. In an exemplary embodiment, as shown in FIG. 13A, which will be discussed in greater details below, the heads of the present disclosure may include tabs 206 that are positioned on the body connector 205 in different locations. When the body connector 205 is received into the head connector 80, the tabs 206 are configured to trigger different switches 86 thereby identifying the particular head connected to the body 50. The controller 82 may communicate with the sensor system 85 and receive the identification of the head connected to the body 50.

It is to be appreciated that the electrical-mechanical sensor system 85 as described above may be reliable and easy to manufacture, but other sensor systems may be used in accordance with the principles of the present disclosure. In an exemplary embodiment, the heads of the present disclosure may include a signal emitter, and the sensor system 85 may include a signal receiver. For example, the signal emitter may include a radio frequency identification (RFID) emitter, and the sensor system 85 may include an RFID receiver. As another example, the signal emitter may include a bar code, and the sensor system 85 may include an optical scanner configured to read the bar code and transmit the bar code to the controller 82 for decoding. As yet another example, the signal emitter may emit a magnetic signal, such as a magnetic strip, and the sensor system 85 may include a sensor configure to read and receive the magnetic signal.

Depending on the type of cleaning head that is attached to the body, the controller may control one or more aspects of the spray outlet(s) of the appliance based on the identity of the cleaning head. For example, if a cleaning head with bristles is attached to the body, then it may be desirable for a particular type or amount of cleaning liquid to be applied to the floor. Or, if a cleaning head with a mop arrangement is attached to the body, then it may be desirable for a type of cleaning liquid different from that corresponding to the bristled cleaning head to be applied to the floor, or for a different amount to be applied. For example, the mounting of a bristle head may allow one pump and spray outlet to operate, while the mounting of a cleaning pad head may allow two pumps and spray outlets to operate. Or, the type of cleaning head that is mounted to the body may dictate the rate at which liquid is dispensed from the one or more outlets. This embodiment may include a trigger on the handle that can override the controller and activate the pumps if the user desires to vary the amount of liquid being supplied or the arrangement of spray outlets being used. A selector, also, may be included in this embodiment In other embodiments of the present disclosure, the body portion 53 may have a reservoir receptacle that is configured to receive and support a reservoir, such as a bottle containing a cleaning/treatment liquid. The body portion may have a lock configured to prevent removal of the reservoir when the body portion is inverted with respect to a normal cleaning orientation. The lock also may be configured to permit removal of the reservoir when the body portion is in a normal cleaning orientation.

Figure 10D:
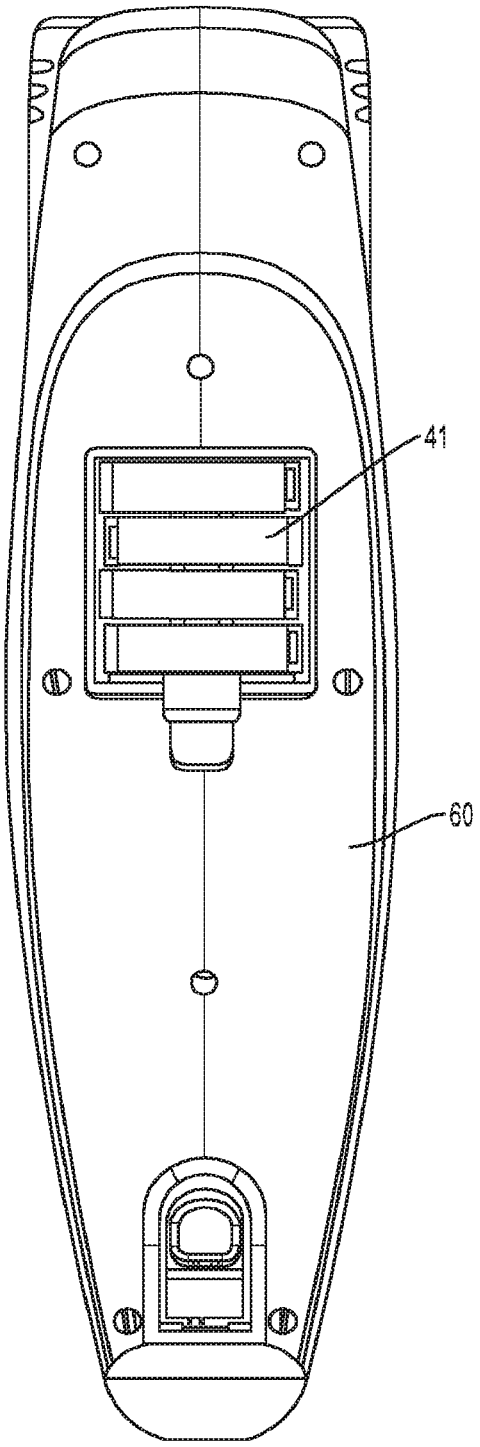
Figure 11:
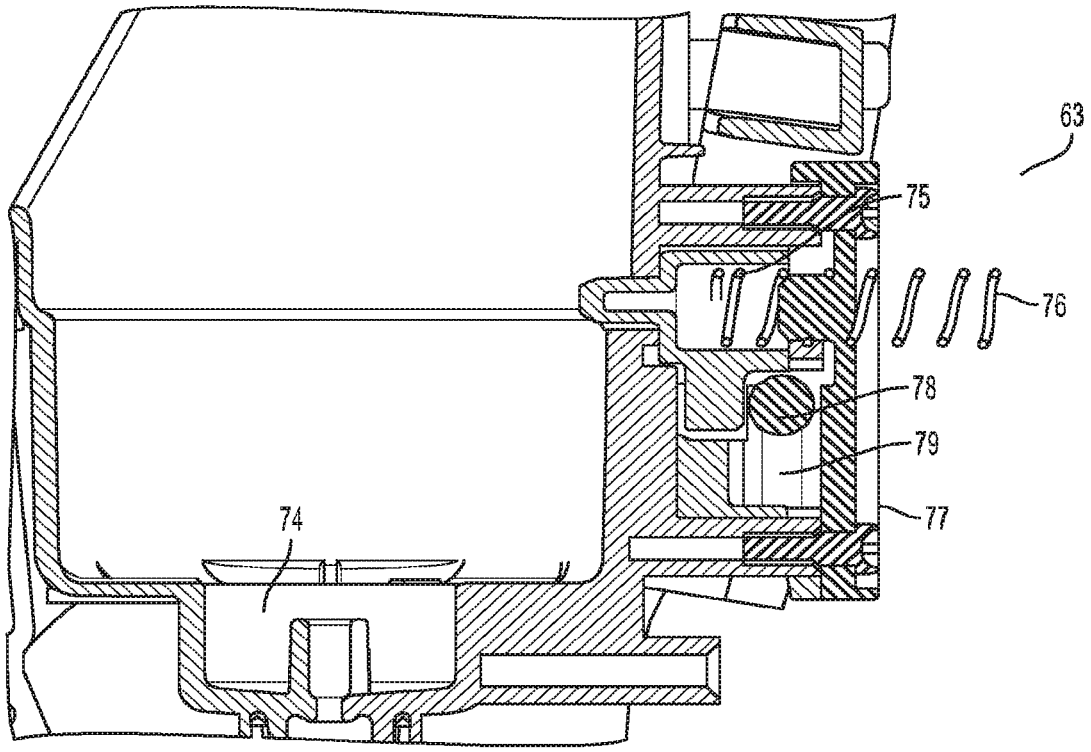
FIG. 11 is a cross-sectional view of a lock mechanism of an appliance in accordance with an embodiment.

FIG. 10D shows the back cover 60 of the body portion 53 including an alternative parallel battery tray 41, though of course, other battery tray designs may be used. FIG. 11 depicts an illustrative embodiment of a bottle lock mechanism 63 that includes a latch 75, an elastic member 76, a cover 77, and a ball 78. The elastic member 76 biases the latch 75 in a closed position. As shown in FIG. 11, the elastic member 76 provides a biasing force on to the latch 75 toward the receptacle for the bottle.

When the body 50 of the appliance is in a normal operational orientation, the ball 78 resides at the bottom of a ball chamber 79, enabling the latch 75 to slide back and forth. This allows a bottle to easily be removed. Though, if the body 50 is inverted from the normal operational orientation (e.g., the appliance is lifted into an upside down position), the ball 78 moves to a position within the ball chamber 79 that prevents the latch 75 from moving away from the receptacle. That is, when the ball falls to a position such as that shown in FIG. 11, the latch 75 is locked in place. Accordingly, when a bottle is suitably located within the reservoir and the unit is inverted, the bottle is prevented from falling out or even being pulled out in some embodiments.

In a further embodiment, different types of heads may use the spray outlets to disperse different types of fluids. For example one floor treatment head may use a first spray outlet to disperse water and a second spray outlet to disperse a cleaning solution, while another floor treatment head may use the first spray outlet to disperse a cleaning solution and the second spray outlet to disperse water. Or, one head may use both spray outlets to disperse water while another head use both spray outlets to disperse cleaning solution. In this embodiment, the apparatus may include a plurality of removable reservoirs designed to store different types of liquids, such as water or cleaning solution. The cleaning apparatus of the present disclosure may further have a plurality of reservoir receptacles to receive the reservoirs. Each reservoir receptacle also has a reservoir sensor system 74A that is in communication with the controller and configured to identify the reservoir that is being housed in the reservoir receptacle. An exemplary location of the reservoir sensor system 74A is illustrated in FIG. 10A. The identity of the reservoirs may be communicated to the controller 82, which in turn selectively activates pumps that direct the appropriate fluid to the appropriate spray outlet depending the type of head attached to the device.

As with the sensor system 85, it is to be appreciated that the reservoir sensor system 74A may be configured in a variety of ways. In an exemplary embodiment, the reservoirs of the present disclosure may include a signal emitter, and the reservoir sensor system 74A may include a signal receiver. For example, the signal emitter may include a radio frequency identification (RFID) emitter, and reservoir sensor system 74A may include an RFID receiver. As another example, the signal emitter may include a bar code, and the reservoir sensor system 74A may include an optical scanner configured to read the bar code and transmit the bar code to the controller 82 for decoding. As yet another example, the signal emitter may emit a magnetic signal, such as a magnetic strip, and reservoir sensor system 74A may include a sensor configure to read and receive the magnetic signal.

In further embodiments, a cleaning or treatment head may be attached to the body such that the body is rotatable forward and backward about a first axis, and such that the body portion is rotatable side to side about a second axis. A suitable connecting member may be employed, having different portions that allow rotation about the first and second axes, for example a first member portion associated with the first axis and a second member portion associated with the second axis. In some embodiments, the first and second member portions, associated with respective axes about which the body is rotatable, extend in such a manner so as to form an angle.

Figure 12A:
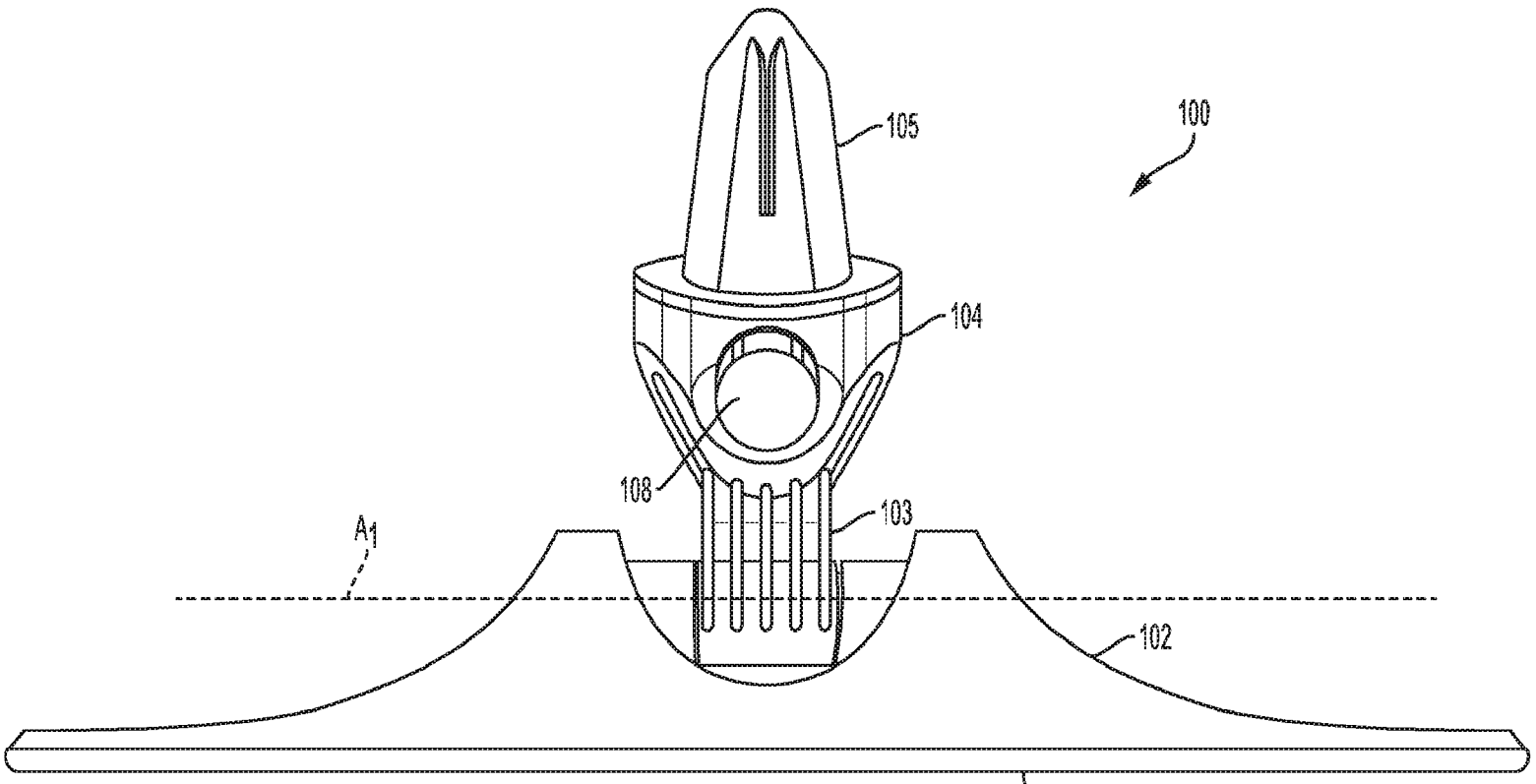
FIGS. 12A-12F are various views of a treatment head in accordance with an embodiment.
Figure 12B:
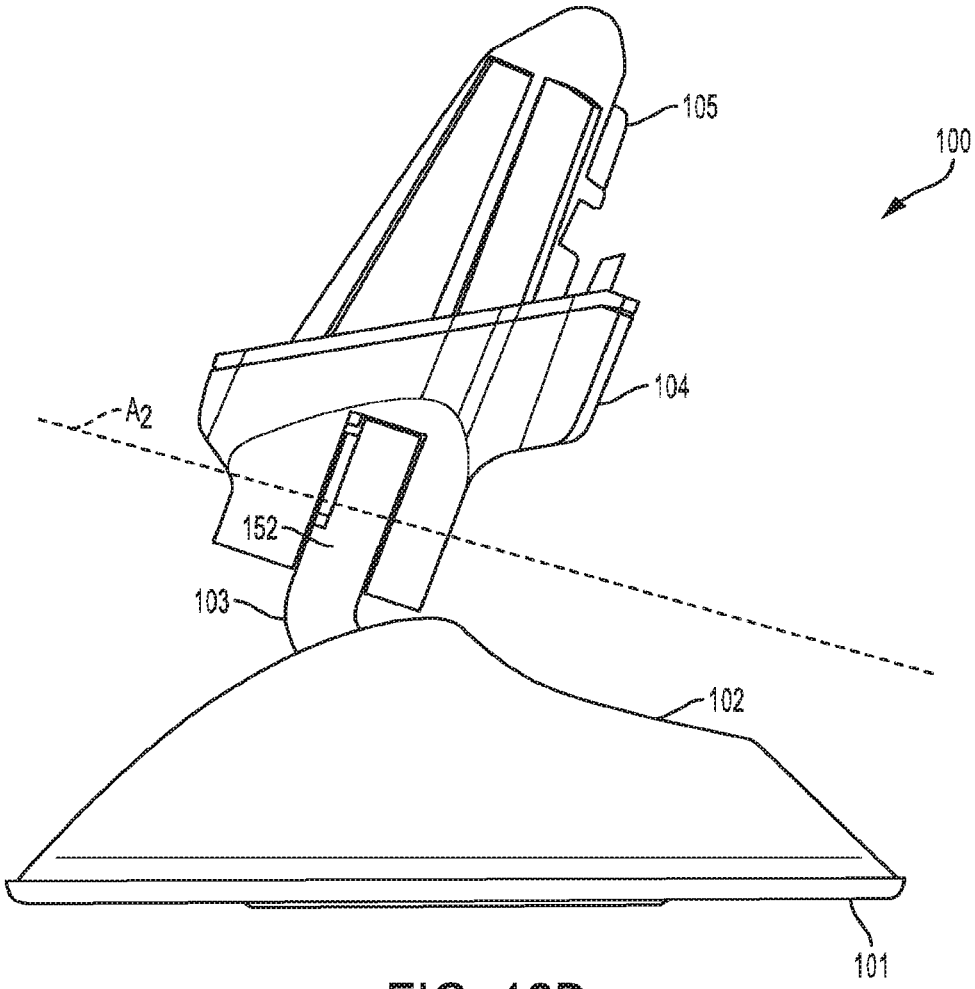

FIGS. 12A-12F depict an illustrative embodiment of a cleaning head 100 (e.g., head for cleaning a hard floor) having a bottom portion 101, a top cover 102, a joint member 103, a body connector base 104, and a body connector 105. In one embodiment, as shown in FIG. 12A, the top cover 12 surface tapers closer to the bottom portion 101, along one or more of the edges of the bottom portion 101, so that one or more edges of the cleaning head 100 are thin and can fit under refrigerators and other appliances. Here, spray outlets may be positioned closer to the front of the head while still allowing for suitable maneuverability of the appliance. In one embodiment, the cleaning head 100 may have one or more spray outlets located on the spray head 100. Also, the one or more spray outlets may have a fixed or adjustable spray nozzle to provide a fixed spray coverage area or a range of spray coverage areas.

Figure 12C:
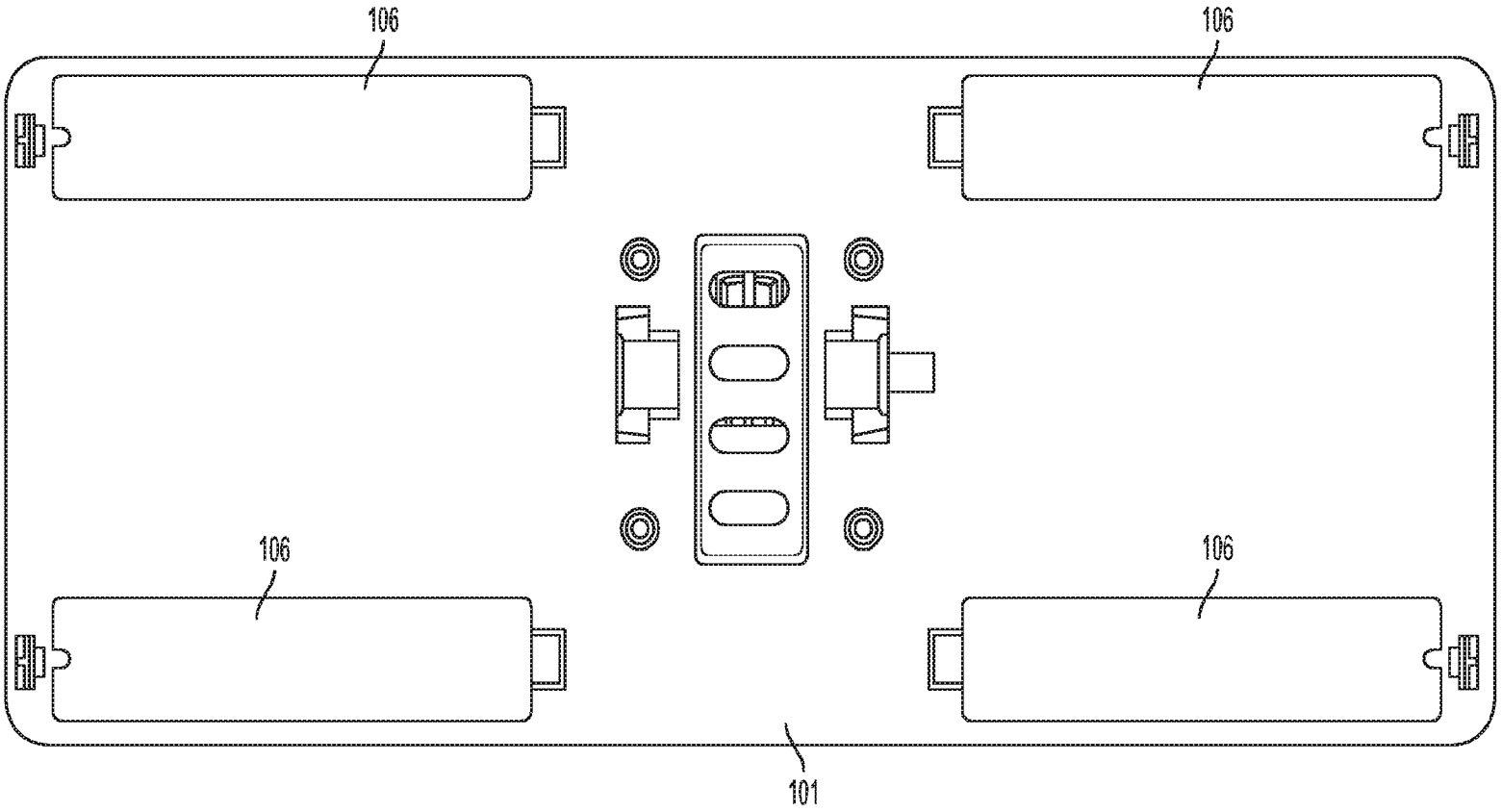
Figure 12D:
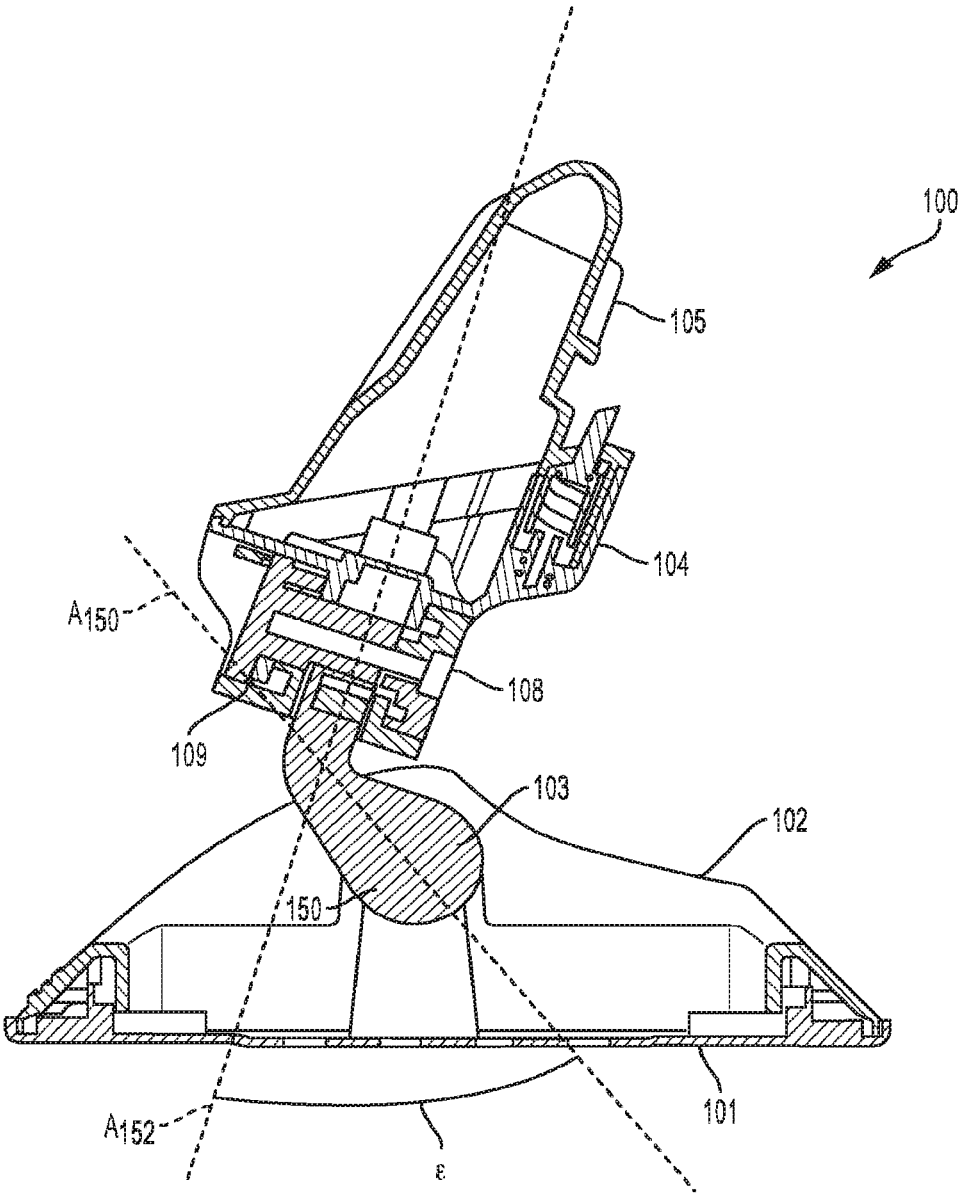
Figure 12E:
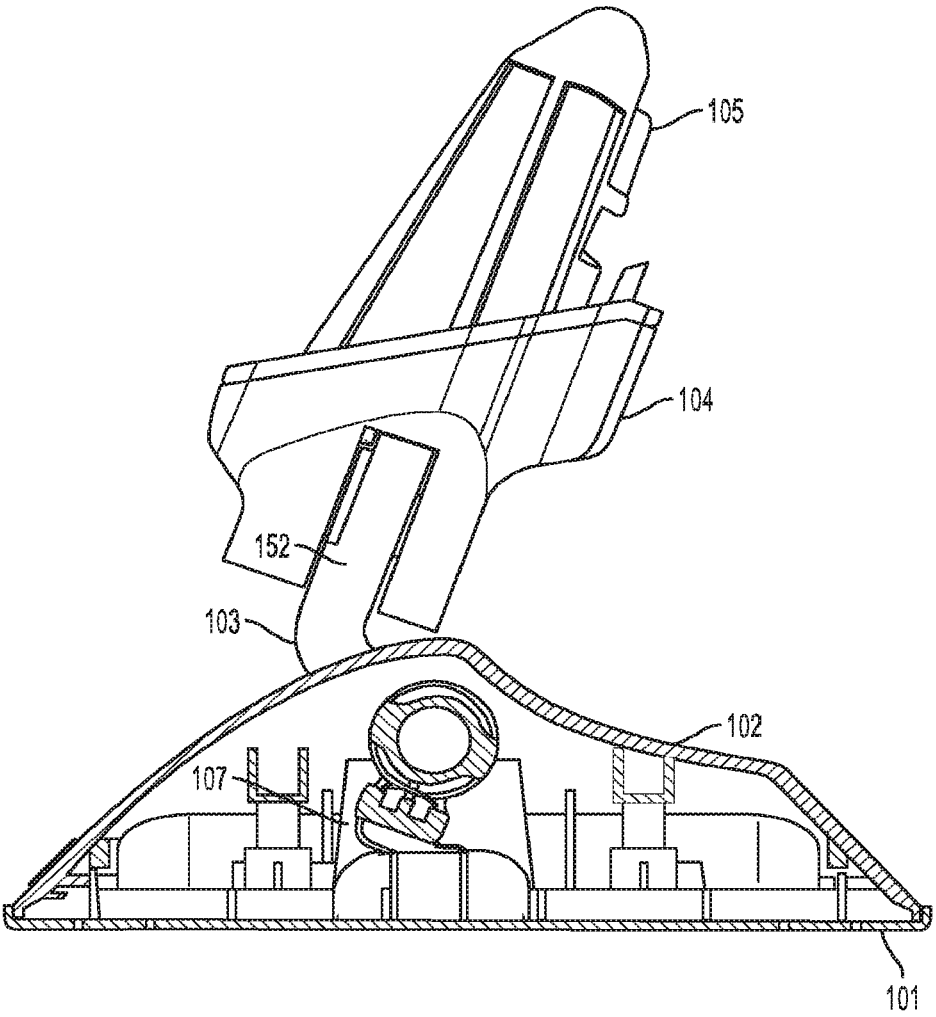
Figure 12F:
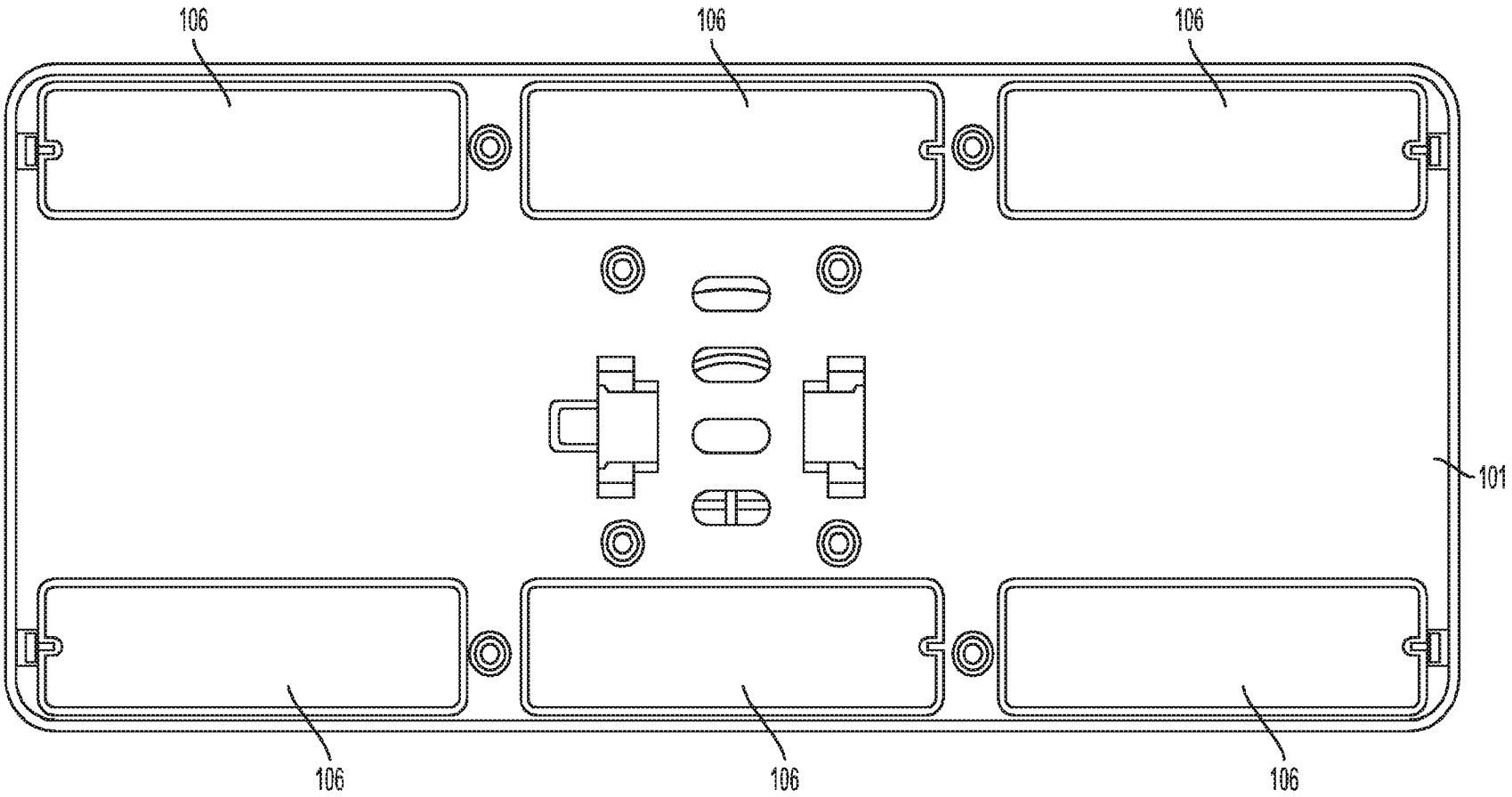

Optionally, as shown in FIG. 12C and FIG. 12F, the bottom portion 101 has one or more hook fields 106 for attachment to a floor cleaning pad. Any number of hook fields 106 may be used for attaching a floor cleaning pad to the bottom portion 101. Alternatively, other attaching means, such as a clamp, may be used to attach a floor cleaning pad to the bottom portion 101.

The top cover 102 is attached to the bottom portion 101. The joint member 103 is allowed to swivel about the top cover 102. The connection between the joint member 103 and the top cover 102 allows the body to rotate about a first axis $A_1$. A torsion spring 107 is provided so as to locate the joint member 103 in a preferred rest position (e.g., shown in the figures at 20 degrees), for easy connection to a main body.

A pin member 108 connects the joint member 103 to the body connector base 104, allowing for mutual rotation there about. That is, the connection between the joint member 103 and the body connector base 104 allows the body to rotate about a second axis $A_2$. A torsion spring (109) locates the joint in a preferred position for easy connection to a main body. The body connector (105) is fastened to the body connector base (104).

The joint member 103 may have a first member portion 150 (shown in FIG. 12D) attached to the top cover 102 and a second member portion 152 (shown in FIGS. 12B and 12C) attached to the body connector base 104. The first member portion 150 may extend substantially along a direction $A_{150}$ and the second member portion 152 may extend substantially along a direction $A_{152}$ such that the directions $A_{150}$ and $A_{152}$ form an angle θ with respect to one another. In some embodiments, the angle θ between directions $A_{150}$ and $A_{152}$ is between 45 degrees and 135 degrees, or between 60 degrees and 120 degrees, or between 80 degrees and 100 degrees, or is approximately 90 degrees. Or, the angle θ between directions $A_{150}$ and $A_{152}$ falls outside of the above noted ranges in some embodiments. In some embodiments, the joint member may be L-shaped, or may have any other suitable shape.

Figure 13B:
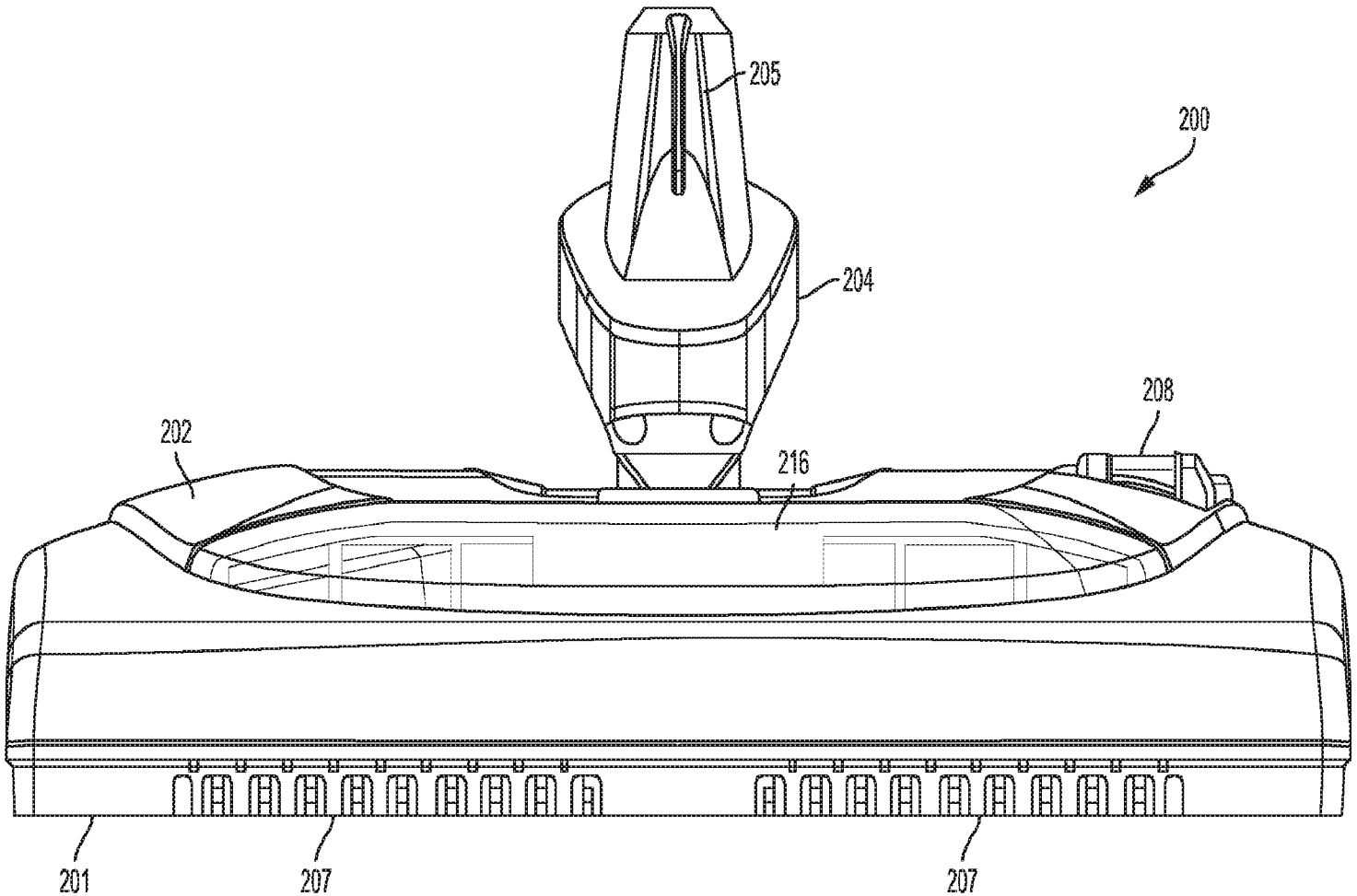
Figure 13C:
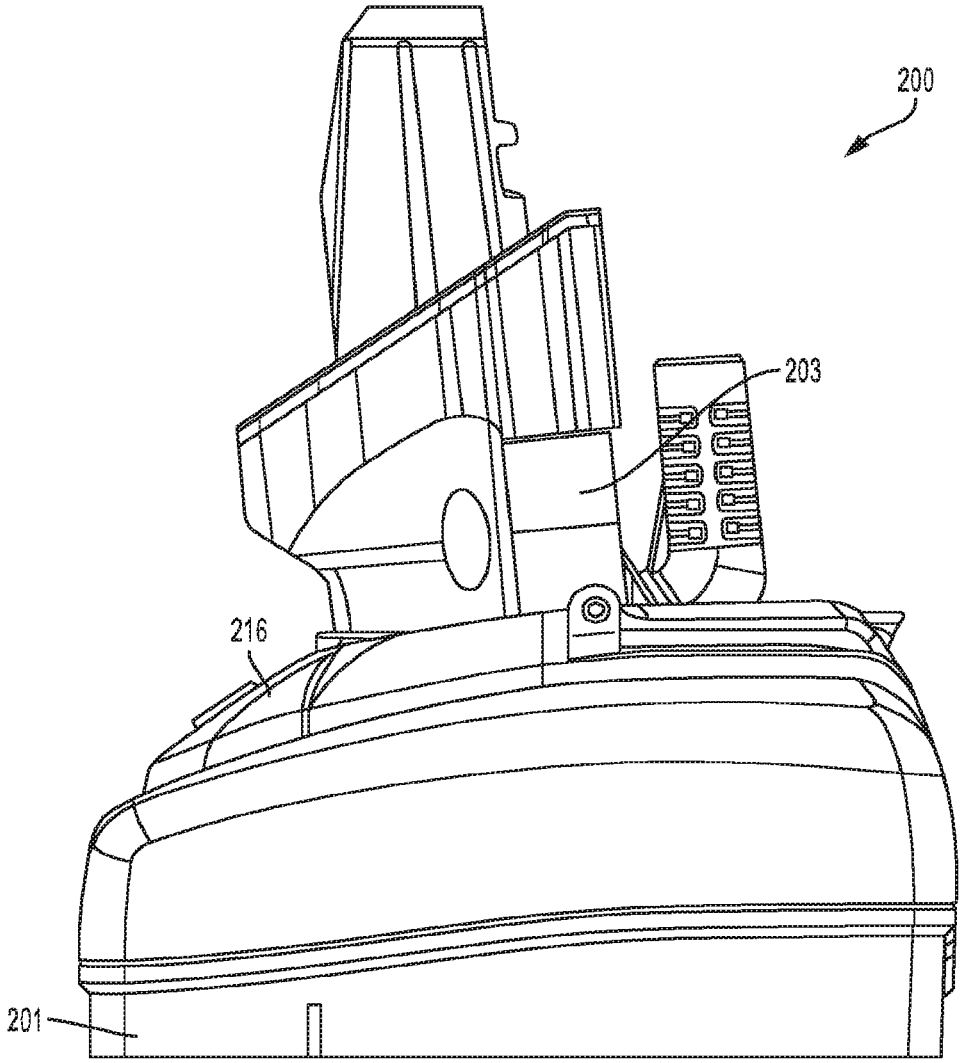

FIGS. 13A-13C depict an illustrative embodiment of a cleaning head 200 (e.g., head for steam cleaning a floor) having a bottom portion 201, a top portion 202, a joint member 203, a body connector base 204, and a body connector 205. The joint member 203 and body connector base 204 allow the user to steer the appliance body 50 and cleaning head 200 in various directions. The cleaning head 200 is removably attachable, via the body connector 205, to the appliance body 50. The cleaning head 200 may also have one or more outlets 207 for directing steam onto a surface. In an alternative embodiment, one or more spray nozzles may be located on the cleaning head 200. The cleaning head 200 may also include a water reservoir 209 for storing water. The water reservoir cap 208 is hingedly fixed to the top portion 202. The water reservoir cap 208 may be opened so the user can fill the water reservoir 209 with water. The water reservoir 209 includes a drain that connects to a pipe or tube that connects the water reservoir to the pump 214. The pump 214 pumps the water to the boiler 215 and the boiler 215 heats the water and then it is distributed through the outlets 207.

Figure 13D:
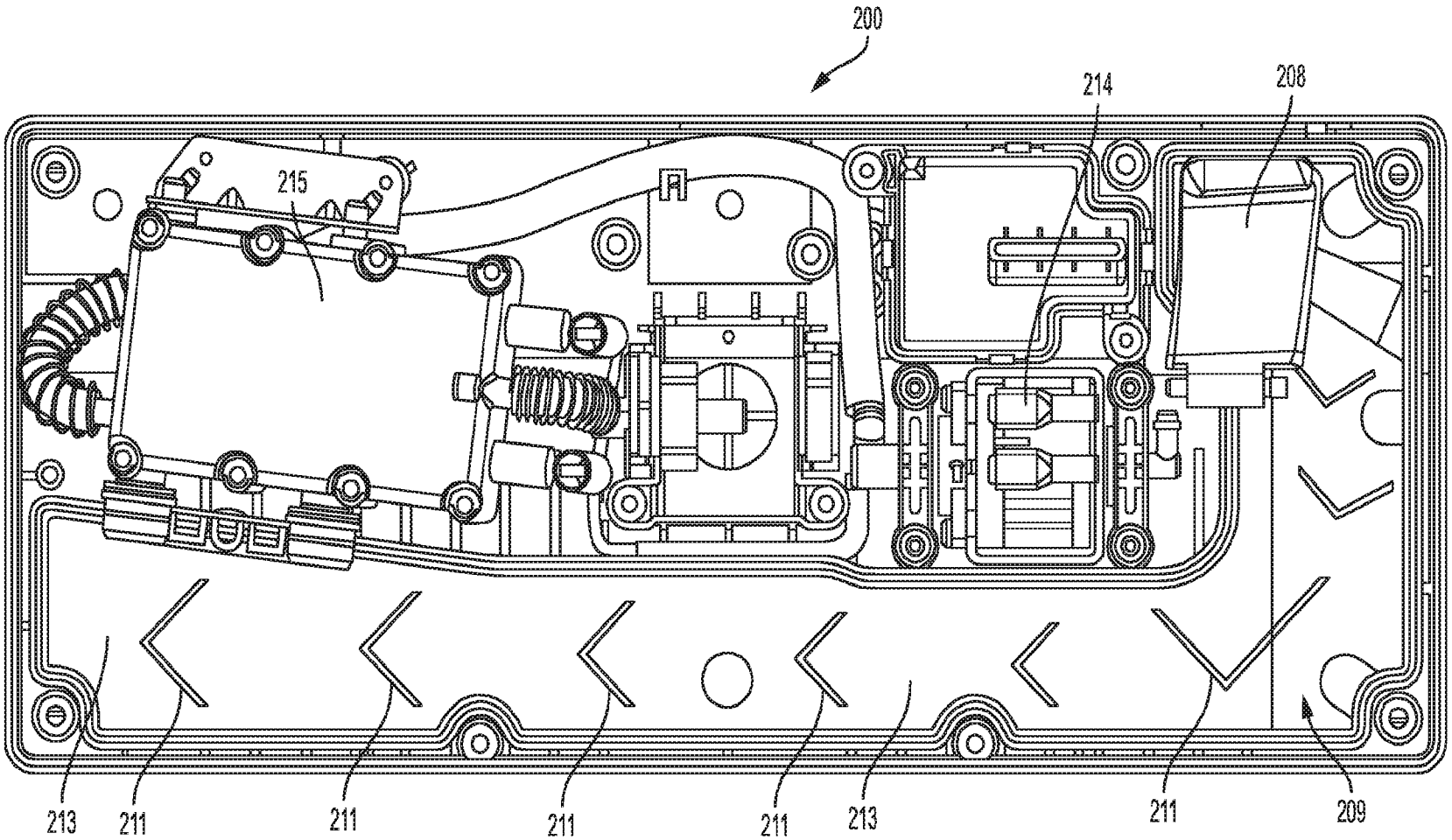
Figure 13E:
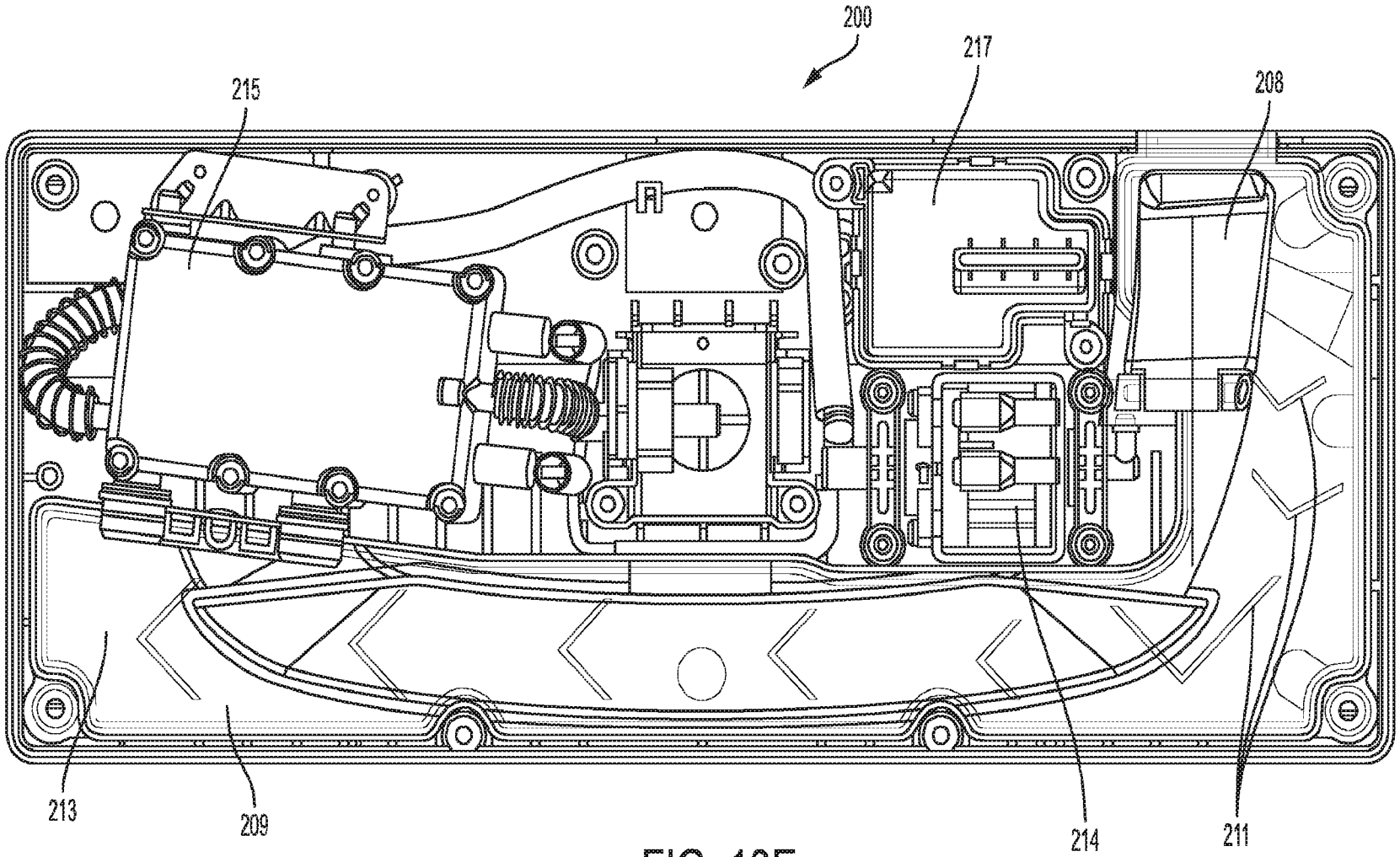

The water reservoir 209 may also include one or more baffles 211, as shown in FIGS. 13C-13D. The baffles 211 comprise one or more members that may be attached to the water reservoir floor surface 213 and extend upward in a substantially perpendicular direction. The baffles 211 may extend partially or completely from the water reservoir floor surface 213 up to the water reservoir top surface 216. The baffles 211 partially block water movement in the water reservoir 209 so the water reservoir drain and pump 214 are more likely to have a consistent water supply, even if the cleaning head 200 is tilted away from the pump 214. The baffles may be "v-shaped", as shown in FIGS. 13C-13D, straight, s-shaped or any other shape that partially blocks water movement through the water reservoir 209.

The cleaning head 200 may also include a printed circuit board 217 which mechanically supports and electrically connects electronic components using conductive tracks, pads and other features etched from copper sheets laminated onto a non-conductive substrate. Optionally, the bottom portion 201 has one or more hook fields for attachment to a floor cleaning pad.

In one embodiment, the cleaning head main components are located at specific distances from the joint member 203, so that each of the components has a substantially equal moment of force about the point where the joint member 203 connects to the cleaning head 200. In some embodiments, an appliance may be adapted to be used to treat or clean surfaces other than floors. For example, handheld versions of embodiments disclosed herein may be used to clean or otherwise treat walls, countertops, appliances, etc.

In one embodiment, a surface treating device includes a body 50 having a first end and a second end, a handle 51 configured to be coupled to the first end of the body 50, and a floor treatment head 200 having a connector 205 configured for coupling to the second end of the body 50. In this embodiment, the floor treatment head 200 includes a water reservoir 209, a heating element 215 for converting water from the water reservoir 209 to steam, and an outlet 207 for delivering the steam onto a surface to be cleaned, where the water reservoir 209 and the heating element 215 are substantially on the same plane. In other words, the water reservoir 209 and the heating element 215 may be adjacent to each other, with both of these elements underneath the connector 205. The water reservoir 209 may be distributed across the width of the floor treatment head 200 to improve the handling of the floor treatment head 200. In other words, the water reservoir 209 is better balanced across the width of the floor treatment head 200 to provide stability and ease of operation.

In one example, the water reservoir 209 and the connector 205 are at distal ends of the floor treatment head 200. In another example, the floor treatment head 200 is operable to support a removably attachable floor cleaning pad (not shown). In some embodiments, the water reservoir 209 includes one or more members 211 perpendicularly attached to an interior surface 213 of the water reservoir 209, where the members 211 are operable to mitigate water movements through the water reservoir 209. In other words, the members 211 may function like baffles to control the amount of water that flows throughout the water reservoir 209. In one embodiment, the water reservoir 209 extends along one or more sides of the floor treatment head 200. In operation, the water reservoir 209 and the heating element 215 are both located at substantially equal distance from the connector 205 such that substantially similar moments of force (e.g., torque) are exerted on the water reservoir 209 and the heating element 215 when the floor treatment head 200 is in use. In other words, because the water reservoir 209 and the heating element 215 are adjacent to each other and are both located at substantially equal distance from the connector 205, the torque or weight distribution can be improved when using the cleaning head 200 such that an equal amount of torque can be exerted on the cleaning head 200. In one embodiment, the surface treating device further includes an adjustable spray outlet 71 located on the body 50. Alternatively, the adjustable spray outlet (not shown) may be located on the floor treatment head 200.

In one embodiment, a surface treating system includes a body 50 and at least two swappable floor treatment heads 100, 200 where each of the first floor treatment head 100 and the second floor treatment head 200 is configured to be removably attachable to the body 50, and where the body 50 is configured to receive only one floor treatment head 100, 200 at a time. The first floor treatment head 100 includes a hard floor cleaning head having a base 101, where the base 101 is capable of supporting a first removably attachable floor cleaning pad (not shown). The second floor treatment head 200 includes a steam cleaning head 200 having a connector 205 configured for coupling to the body 50, the steam cleaning head 200 having a water reservoir 209, a heating element 215 operable to convert water from the water reservoir 209 to steam, and an outlet 207 for delivering the steam onto a surface to be cleaned, where the water reservoir 209 and the heating element 215 are substantially on the same plane.

In one embodiment, the water reservoir 209 and the connector 205 are at distal ends (e.g., opposite ends) of the steam cleaning head 200. In another embodiment, the steam cleaning head 200 is operable to support a second removably attachable floor cleaning pad (not shown). In some embodiments, the water reservoir 209 includes one or more members 211 perpendicularly attached to an interior surface 213 of the water reservoir 209, the members 211 operable to mitigate water movements through the water reservoir 209.

In one embodiment, the surface treating system further includes an adjustable spray outlet 71 located on the body 50. Alternatively, the adjustable spray outlet may be located on the hard floor treatment head 100, or on the steam cleaning head 200 as can be appreciated by one skilled in the art by routing lines from the body 50 into the respective cleaning heads 100, 200. In another embodiment, the water reservoir 209 extends along one or more sides of the steam cleaning head 200. In operation, the water reservoir 209 and the heating element 215 are both located at substantially equal distance from the connector 205 such that substantially similar moments of force are exerted on the water reservoir 209 and the heating element 215 when the steam cleaning head 200 is in use.

In an embodiment, the pump 214 and the heating element 215 of the steam cleaning head 200 may be configured to be activated by the controller 85 of the appliance in synchronization with the pumps 65 of the appliance. It is to be appreciated that a variety of synchronization of the pump 214, heating element 215, and the pumps 65 may be implemented to synergistically deliver steam and the appropriate cleaning liquid(s) in various order or substantially contemporaneously.

In one embodiment, a surface treating apparatus includes a body 50, and a floor treatment head 21 disposed with the body 50, the floor treatment head 21 including a member 11 for supporting a brush roll 30, the brush roll 30 having a plurality of floor treatment implements 17A, 17B. In another embodiment, the brush roll 30 is removably detachable from the member 11. In one instance, the brush roll 30 includes a plurality of brush roll modes pertaining to the plurality of floor treatment implements or other brush roll modes.

In one mode of operation, a first brush roll mode includes a first floor treatment implement 17A positioned to be in contact with a floor surface without a second floor treatment implement 17B being in position to be in contact with the floor surface. In another mode of operation, a second brush roll mode includes a second floor treatment implement 17B positioned to be in contact with a floor surface without a first floor treatment implement 17A being in position to be in contact with the floor surface. In yet another mode of operation, a third brush roll mode includes a configuration of the brush roll 30 where neither a first floor treatment implement 17A nor a second floor treatment implement 17B is in position to be in contact with a floor surface. In some embodiments, a control member 12 is disposed with the brush roll 30, the control member 12 operable to move and position the brush roll 30 into any of the brush roll modes.

In one embodiment, a surface treating system includes a body 50, and at least three floor treatment heads, where each of first floor treatment head 100, second floor treatment head 200, and third floor treatment head 21 is configured to be removably attachable to the body 50, and whereby the body 50 is configured to receive only one floor treatment head 100, 200, 21 at a time. The first floor treatment head 100 includes a hard floor cleaning head having a base 101, the base 101 operable to support a first removably attachable floor cleaning pad. The second floor treatment head 200 includes a steam cleaning head having a connector 205 configured for coupling to the body 50, the steam cleaning head includes a water reservoir 209, a heating element 215 operable to convert water from the water reservoir to steam, and an outlet 207 for delivering the steam onto a surface to be cleaned, where the water reservoir 209 and the heating element 215 are substantially on the same plane. The third floor treatment head 21 includes a member 11 for supporting a brush roll 30, the brush roll 30 having a plurality of floor treatment implements 17A, 17B.

In one embodiment, the system further includes an adjustable spray outlet 71 located on the body. In another embodiment, the system further includes a controller 82 disposed on the body, and a sensor 85 disposed on the body, whereby the controller is configured to identify which floor treatment head 100, 200, 21 is attached to the body 50 based on information received from the sensor. In operation, the controller is capable of controlling aspects of the adjustable spray outlet 71, the pump rate, and select the appropriate reservoir based on which floor treatment head 100, 200, 21 is attached to the body.

Although the current description has been described in detail with reference to several embodiments, additional variations and modifications exist within the scope and spirit of the disclosure.

What is claimed is:

1. A cleaning apparatus comprising:

a cleaning head configured to be coupled to a handle, said cleaning head comprising:

a base having a first and second opposite lateral end, a top surface, and a bottom surface;

a supporting bar having a central longitudinal axis extending between said first and said second lateral ends, said supporting bar configured to rotate about said central longitudinal axis relative to said base;

a first brush section disposed generally along said central longitudinal axis between said first and said second lateral ends of said supporting bar, said first brush section comprising a first type of bristles extending outward from said supporting bar;

a second brush section disposed generally along said central longitudinal axis between said first and said second lateral ends of said supporting bar and radially offset relative to said first brush section, said second brush section comprising a second type of bristles extending outward from said supporting bar which are different than said first type of bristles; and an adjustment member configured to selectively allow said supporting bar to rotate about said central longitudinal axis between a plurality of positions, said adjustment member further configured to selectively lock said supporting bar in each of said plurality of positions and prevent rotation of said support bar when locked in each of said plurality of positions, said plurality of positions including a first and a second position;

wherein said first position corresponds to said first brush section extending away from said top surface and beyond said bottom surface of said base; and wherein said second position corresponds to said second brush section extending away from said top surface and beyond said bottom surface of said base.

2. The cleaning apparatus of claim 1, further comprising a body, said body further comprising:

a reservoir configured to store a liquid;

a spray outlet;

a pump operable to supply the liquid from said reservoir to said spray outlet; and said handle disposed about a first end of said body.

3. The cleaning apparatus of claim 2, further comprising a swivel disposed between said body and said base configured to allow said base to rotate relative to said body in at least one direction.

4. The cleaning apparatus of claim 2, wherein said cleaning head further comprises a body connector configured to releasably secure said cleaning head to said body.

5. The cleaning apparatus of claim 2, wherein said central longitudinal axis of said supporting bar is configured to extend substantially perpendicular to a longitudinal axis of said body.

6. The cleaning apparatus of claim 1, wherein said adjustment member includes a knob.

7. The cleaning apparatus of claim 6, wherein said knob is located about said first lateral end of said cleaning head.

8. The cleaning apparatus of claim 6, wherein said knob includes a first and a second hole corresponding to said first and said second positions, respectively, said cleaning head further comprising an elastic member configured to bias said adjustment member inward toward said supporting bar so that said adjustment member is placed into one of said first or said second positions provided by said first and said second openings, respectively.

9. The cleaning apparatus of claim 8, wherein said adjustment member is keyed to a bar retainer by a boss into one of said first or said second openings.

10. The cleaning apparatus of claim 1, wherein said adjustment member is further configured to selectively allow said supporting bar to rotate about said central longitudinal axis to a storage position and selectively lock said supporting bar in said storage position;

wherein in said storage position, said bristles of said first and said second brush sections are retracted relative to said bottom surface of said cleaning head.

11. The cleaning apparatus of claim 1, wherein said adjustment member is further configured to selectively allow said supporting bar to rotate about said central longitudinal axis to a remove position in which said supporting bar is configured to be removed from said cleaning head.

12. The cleaning apparatus of claim 1, wherein said first type of bristles have a different length compared to said second type of bristles.

13. The cleaning apparatus of claim 1, wherein said first type of bristles are made from a different material than said second type of bristles.

14. The cleaning apparatus of claim 1, wherein said first type of bristles have a different diameter compared to a diameter of said second type of bristles.

15. The cleaning apparatus of claim 1, wherein said first type of bristles are arranged in different amounts per tuft compared to said second type of bristles.

16. The cleaning apparatus of claim 1, wherein said cleaning head further comprises marking feature indicative of said position of said supporting bar.

17. The cleaning apparatus of claim 1, wherein said cleaning head further comprises side bristles extending from said bottom of said base and located proximate said first lateral end of said base.

18. The cleaning apparatus of claim 1, wherein further comprising a pad disposed generally along said central longitudinal axis between said first and said second lateral ends of said supporting bar and radially offset relative to said first and said second brush sections, wherein said adjustment member is further configured to selectively allow said supporting bar to rotate about said central longitudinal axis to a third position and selectively lock said supporting bar in said third position, said third position corresponding to said pad extending away from said top surface and beyond said bottom surface of said base.

19. The cleaning apparatus of claim 1, wherein said central longitudinal axis of said supporting bar is configured to extend substantially parallel to a cleaning surface.

* * * * *